US008074409B2

(12) United States Patent
Goldberg et al.

(10) Patent No.: US 8,074,409 B2
(45) Date of Patent: Dec. 13, 2011

(54) EXTERIOR WALL ASSEMBLY INCLUDING MOISTURE REMOVAL FEATURE

(75) Inventors: Louise Franklin Goldberg, Minneapolis, MN (US); Mark Larry Stender, Chaska, MN (US)

(73) Assignee: Moisture Management, LLC, Chaska, MN (US)

( * ) Notice: Subject to any disclaimer, the term of this patent is extended or adjusted under 35 U.S.C. 154(b) by 6 days.

(21) Appl. No.: 12/467,912

(22) Filed: May 18, 2009

(65) Prior Publication Data

US 2010/0287862 A1 Nov. 18, 2010

(51) Int. Cl.
*E06B 7/14* (2006.01)

(52) U.S. Cl. ..... 52/209; 52/302.3; 52/302.6; 52/408; 52/169.5

(58) Field of Classification Search ..... 52/209, 52/204.52, 302.1, 302.3, 302.6, 302.7, 169.5, 52/408

See application file for complete search history.

(56) References Cited

U.S. PATENT DOCUMENTS

| | | | | | |
|---|---|---|---|---|---|
| 1,976,166 | A | * | 10/1934 | Fricdberg | 52/302.6 |
| 2,264,961 | A | * | 12/1941 | Ward | 52/302.3 |
| 2,324,971 | A | | 7/1943 | Woodward | |
| 3,561,177 | A | | 2/1971 | Agro et al. | |
| 3,568,391 | A | * | 3/1971 | Conway | 52/586.2 |
| 3,990,202 | A | | 11/1976 | Becker | |
| RE29,804 | E | | 10/1978 | Becker | |
| 4,472,916 | A | | 9/1984 | Krebs | |
| 4,506,595 | A | * | 3/1985 | Roberts et al. | 454/187 |
| 4,841,687 | A | * | 6/1989 | Navetta | 52/58 |
| 5,027,572 | A | * | 7/1991 | Purcell et al. | 52/309.9 |
| 5,218,798 | A | * | 6/1993 | Bentivegna et al. | 52/206 |
| 5,343,661 | A | * | 9/1994 | Sourlis | 52/169.5 |
| 5,410,852 | A | | 5/1995 | Edgar et al. | |
| 5,598,673 | A | * | 2/1997 | Atkins | 52/302.1 |
| 5,706,804 | A | | 1/1998 | Baumann et al. | |
| 5,799,454 | A | * | 9/1998 | Andersson et al. | 52/302.3 |
| 5,860,259 | A | | 1/1999 | Laska | |
| 5,946,870 | A | * | 9/1999 | Bifano et al. | 52/254 |
| 5,953,883 | A | | 9/1999 | Ojala | |
| 5,988,264 | A | * | 11/1999 | Goldsmith | 165/48.1 |
| 6,101,775 | A | * | 8/2000 | Larimore | 52/302.1 |

(Continued)

FOREIGN PATENT DOCUMENTS

GB 2169071 A 7/1986

OTHER PUBLICATIONS

The Office Action mailed on Sep. 4, 2008 in the related application, U.S. Appl. No. 11/251,661.

*Primary Examiner* — Robert Canfield
*Assistant Examiner* — Babajide Demuren
(74) *Attorney, Agent, or Firm* — Dicke, Billig & Czaja, PLLC

(57) ABSTRACT

A wall assembly includes a wall frame, a trough, a moisture transport spacer coupled to the wall frame and providing a substantial barrier to the passage of air and moisture vapor through the wall assembly, a moisture wicking sheet disposed at a bottom of the wall frame and extending from the moisture transport spacer to the trough, and an air seal disposed between the moisture wicking sheet and the bottom of the wall frame. The trough communicates with a dynamic ventilation system configured to remove moisture collected in the trough.

18 Claims, 24 Drawing Sheets

U.S. PATENT DOCUMENTS 6,108,991 A * 8/2000 Hagan et al. ..... 52/302.3
6,131,353 A * 10/2000 Egan ..... 52/408
6,134,847 A * 10/2000 Bifano et al. ..... 52/58
6,148,570 A 11/2000 Dinwoodie et al.
6,233,890 B1 5/2001 Tonyan
6,298,620 B1 * 10/2001 Hatzinikolas ..... 52/302.1
6,385,925 B1 * 5/2002 Wark ..... 52/209
6,385,932 B1 * 5/2002 Melchiori ..... 52/302.3
6,550,212 B2 4/2003 Lubker, II
6,578,331 B1 6/2003 Leslie et al.
6,594,965 B2 * 7/2003 Coulton ..... 52/302.1
6,745,531 B1 6/2004 Egan
6,786,013 B2 * 9/2004 Coulton ..... 52/198
7,247,090 B2 7/2007 Vacek
7,309,665 B2 12/2007 Qureshi et al.
2002/0073628 A1 * 6/2002 Dextras ..... 52/1
2002/0108333 A1 * 8/2002 Clayton ..... 52/302.1
2002/0152693 A1 * 10/2002 Krogstad ..... 52/58
2003/0126810 A1 * 7/2003 Brunson et al. ..... 52/169.5
2003/0230035 A1 * 12/2003 Collins et al. ..... 52/209
2004/0003558 A1 * 1/2004 Collins et al. ..... 52/302.1
2004/0226238 A1 11/2004 Haapiainen
2004/0255533 A1 * 12/2004 Koester ..... 52/302.1
2005/0210787 A1 * 9/2005 Koester ..... 52/302.1
2006/0117687 A1 * 6/2006 Ehrman et al. ..... 52/302.1
2006/0123723 A1 6/2006 Weir et al.
2006/0283102 A1 * 12/2006 Sourlis ..... 52/62
2007/0094957 A1 * 5/2007 Burton et al. ..... 52/209
2007/0193151 A1 * 8/2007 Anderson ..... 52/302.3
2007/0199265 A1 * 8/2007 Iske et al. ..... 52/302.1
2007/0204541 A1 * 9/2007 Sade ..... 52/302.1

* cited by examiner

EXTERIOR WALL ASSEMBLY INCLUDING MOISTURE REMOVAL FEATURE

CROSS-REFERENCE TO RELATED APPLICATIONS

This Utility Patent Application is related to commonly assigned and concurrently filed Utility patent application Ser. No. 12/467,902, entitled EXTERIOR WALL ASSEMBLY INCLUDING MOISTURE TRANSPORTATION FEATURE, and which is herein incorporated by reference.

BACKGROUND

Improvements in construction materials, construction methods, and more stringent local and state building codes have contributed to improved energy efficiency of new and remodeled insulated wall structures for homes and buildings.

The conventional approach to fabricating a highly energy-efficient wall is to erect a wall frame supporting multiple layers of insulation placed between interior and exterior layers of the wall. One or more breathable "house-wrap" styled layers is secured (e.g., stapled) to an exterior sheathing surface to prevent bulk water from wetting the insulation and thus reducing its insulative value (R-value), as well as wetting the sheathing and framing causing mold and rot. Typically, a low permeance (<0.1 perm polyethylene membrane) is attached to the warm-in-winter side of the framing members. Continuing experience shows that the combined effect of dry sheathing and a warm-side vapor retarder results in walls that have a tendency to retain moisture, which can undesirably lead to mold growth within the wall, degradation of the wall, insects, and/or other moisture-related problems. These conventional insulated wall structures also reduce heat loss through the wall by reducing drafts (infiltration) that remove heat from the home/building. However, since these conventional insulated wall structures are so tightly constructed/sealed, any water that is trapped in the wall (e.g., due to a breach or damage to the structure or to condensation build-up) tends to remain inside the wall. Moisture that is trapped inside a wall reduces the performance of the insulation and has the potential to feed the growth of mold and/or bacteria.

Moisture trapped inside of the walls includes moisture vapor and bulk water, such as condensation. Condensation can form inside a wall due to temperature differences across the insulated walls. For example, during typical northern cold winter months, the air outside of an insulated wall is cold and dry, and the air inside of the wall is relatively warm and humid. Thus, a natural humidity gradient is formed that drives moisture vapor in the air inside the wall toward the exterior of the wall. Large gradients between outside and inside air temperature and humidity can lead to a significant accumulation of moisture condensation within the insulated wall.

The opposite conditions occur during the summer months, when the air outside the structure is warm and humid, and the air inside the structure is conditioned to be cooler and dryer. Thus, during summer months a natural humidity gradient exists to drive warm humid air toward an interior of the insulated wall, which can analogously lead to a significant accumulation of moisture condensation within the insulated wall.

In some cases moisture accumulation in the insulated wall arises from wind driven water that enters the wall along a window or door seam. This form of moisture ingress can, for example, be the result of poor workmanship or from a deterioration of flashing or sealants around the window/door. In any regard, once the wall accumulates moisture it is difficult to dry the wall to a level that will not support the growth of mold and/or bacteria.

Owners, manufacturers, and remodelers of wall structures desire walls that are energy efficient, durable, and compatible with accepted construction practices.

SUMMARY

One aspect provides a wall assembly including a wall frame, a trough, a moisture transport spacer coupled to the wall frame and providing a substantial barrier to the passage of air and moisture vapor through the wall assembly, a moisture wicking sheet disposed at a bottom of the wall frame and extending from the moisture transport spacer to the trough, and an air seal disposed between the moisture wicking sheet and the bottom of the wall frame. The trough communicates with a dynamic ventilation system configured to remove moisture collected in the trough.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1:
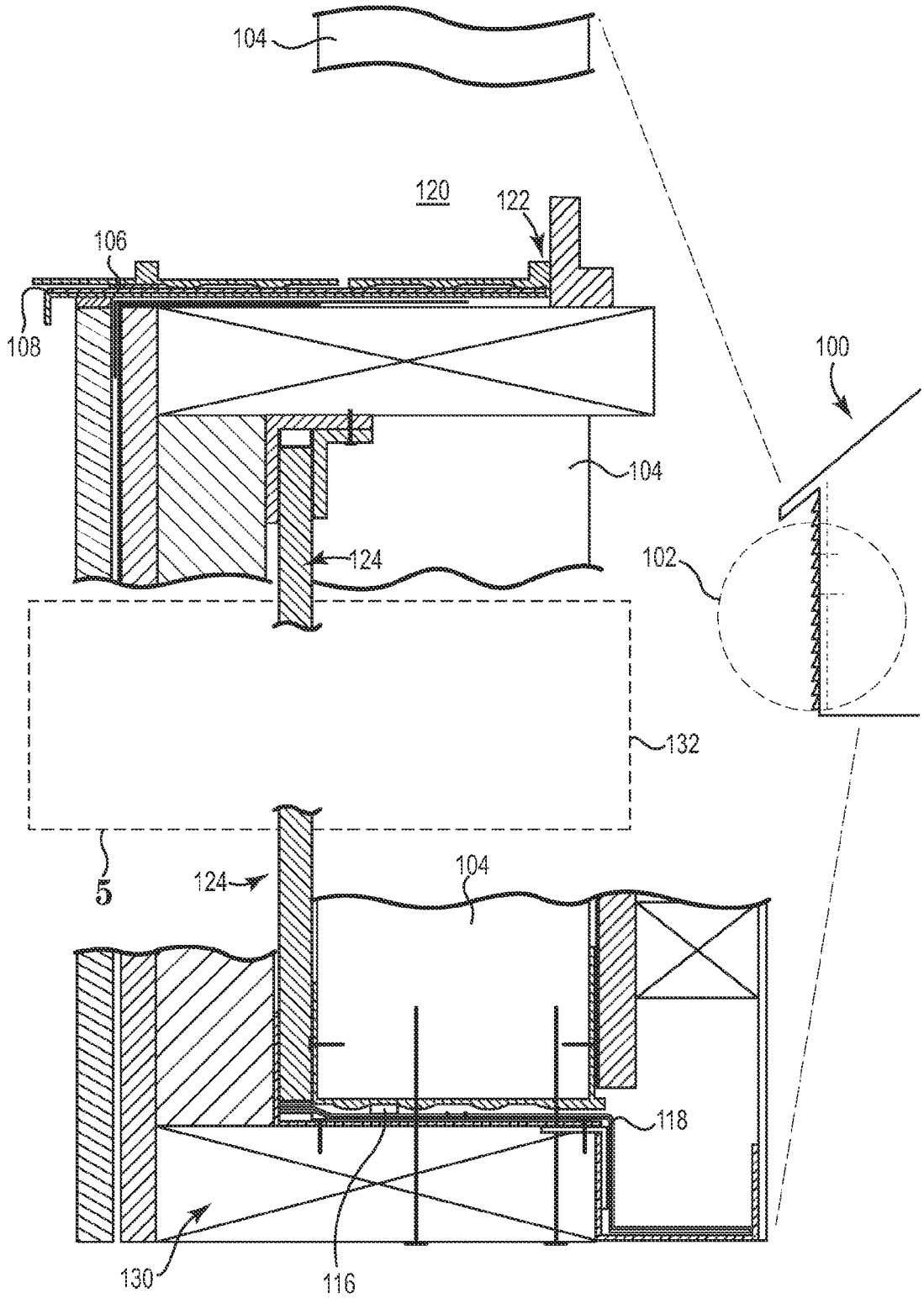
FIG. 1 is a schematic representation of a building wall assembly including a flexible sheet configured to direct moisture out of the wall assembly according to one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

As used herein, moisture includes bulk liquid water, such as rain or rain droplets, and moisture vapor, such as humidity contained in the air.

As used herein, fluid is a broad term that includes both gases and liquids.

As used herein, barrier means to substantially prevent or deny the through-passage of air and to substantially prevent or deny the passage of moisture vapor. Thus, barrier as used herein means to substantially prevent the through-passage of moisture through the barrier, whether the moisture is in the form of moisture vapor or bulk liquid. As an example, conventional house wrap materials (e.g., nonwoven sheets of polyethylene or Tyvek™ sheets and the like) are not barriers since they do permit the passage of air (which can contain moisture vapor) through the sheet. A solid polyethylene film several milli-inches thick, in contrast, is a barrier to the through-passage of air, moisture vapor, and bulk liquid.

Embodiments provide a sheet configured to remove moisture from a wall assembly, and particularly for sealed and insulated wall assemblies.

Embodiments provide a sheet that forms a barrier or a water separation plane configured for bulk transportation of moisture, which cooperates with permeable membranes in the sealed wall assembly to allow exterior sourced moisture to dry to the exterior by vapor diffusion and interior sourced moisture to dry to the interior by vapor diffusion. The bulk water that is collected by the barrier is delivered to and removed from a lower portion of the draining assembly. In this way, the water separation plane and the permeable membranes dry the sealed wall assembly by both bulk water transport and vapor diffusion without compromising the interior/exterior liquid and vapor sealing of the wall assembly.

Improvements in building construction have resulted in wall assemblies that are highly energy efficient. These wall assemblies are often highly insulated and include sealed joints around windows and doors to prevent drafts. While these walls have high thermal efficiency, it has been observed that moisture can potentially accumulate inside the wall over time due to naturally occurring temperature and/or humidity gradients. In addition, moisture can potentially accumulate inside sealed walls due to water running down a steeply pitched roof, for example in the case where the joint/seal between the wall and the roof deteriorates and provides an ingress location for water into the wall.

Insulated exterior walls in the northern climate are configured to maintain warmth on an interior side of the wall and protect against cold conditions on an exterior side of the wall. Heating the inside of the structure can result in moisture condensation forming on interior portions of the wall assembly because warm air has a greater capacity for holding moisture as compared to cold air. Since the wall assembly is insulated and sealed, any moisture that condenses on interior surfaces of the wall assembly can be undesirably trapped in the wall. Embodiments describe herein provide a passive mechanism for draining moisture out of a sealed wall assembly to an exterior location, regardless of the transport mechanism that delivers the water inside the wall. Other embodiments provide active (or dynamic) transportation of moisture out of a sealed wall assembly to a collection area that is ventilated to dynamically evaporate the moisture.

It has been surprisingly discovered that implementing the moisture transporting features of embodiment described herein enable maintaining the exterior sheathing of a tightly sealed and insulated wall assembly at a low moisture content of about 2%. This represents an improvement of between a factor of 2-4 times in the dryness of a state of the art wall assembly.

Embodiments provide mechanisms to remove moisture that accumulates within a sealed wall assembly, providing sealed walls with a moisture content of less than about 6% for a wide range of humidity gradients and even in the case where bulk water begins to undesirably accumulate inside the wall. In one embodiment, the moisture removal mechanisms described herein dry the interior portions of a sealed wall assembly down to a moisture content that will not support the growth of mold and/or bacteria.

Embodiments of the wall assemblies described herein apply to exterior wall assemblies, sealed and insulated exterior wall assemblies, interior wall assemblies, and/or subterranean wall assemblies. However, sealed exterior wall assemblies are more susceptible to retaining moisture in the form of condensation and thus benefit directly from the embodiments described herein.

FIG. 1 is a schematic representation of a building 100 including a wall assembly 102 according to one embodiment. Wall assembly 102 includes a wall frame 104, a first seal 106 attached to a first flexible sheet 108, and a second seal 116 attached to a second flexible sheet 118. Each flexible sheet 108, 118 is configured to transport moisture away from wall frame 104 and out of wall assembly 102. In one embodiment, at least one of the flexible sheets 108, 118 is configured to transport moisture by capillary action away from wall frame 104.

In one embodiment, wall assembly 102 includes one or more openings 120 formed to receive a window or a door, as examples, and first sheet 108 cooperates with a drain 122 to collect and transport moisture that enters into opening 120 away from wall frame 104. In one embodiment, wall assembly 102 includes a moisture transport spacer 124 (MTS 124, also termed a Dryspacer) configured to form a water separation plane and collect moisture that accumulates inside wall assembly 102 and direct bulk moisture to second sheet 118 for transportation of the moisture out of wall assembly 102. In one embodiment, MTS 124 forms a water separation plane that is configured to drain/direct moisture along both sides of MTS 124 to sheet 118. Condensation or bulk water entering wall assembly 102 from either the interior or the exterior is removed from wall assembly 102 by the combination of MTS 124 and sheet 118, which minimizes or eliminates the potential for mold and/or rot to be produced by moisture that is trapped within the wall.

In one embodiment, wall assembly 102 is provided as a sealed system and includes first seal 106 attached to first sheet 108 and second seal 116 attached to second sheet 118. Seals 106, 116 are provided as fluid seals that prevent the pressure driven flow of moist interior air and/or moist exterior air toward wall frame 104 and to prevent the diffusion of water vapor across sheets 108, 118 (thus preventing the unchecked movement of humid air into wall assembly 102). Seals 106, 116 limit the exchange of humid air through wall assembly 102 to enable sheets 108, 118 to efficiently collect and direct moisture away from wall frame 104. In one embodiment, seals 106, 116 are configured as vapor seals that enable capillary flow along a structure (for example fibers) coupled to one or both of sheets 108, 118.

In one embodiment, wall frame 104 is fabricated on a base 130 and extends through an insulated section 132 (illustrated in FIG. 5) to drain 122 that is placed within opening 120. In one embodiment, wall frame 104 is fabricated of wood 2×4 boards that attaches to 2×6 boards of base 130, although other materials and sizes are also acceptable. Seals 106, 116 and sheets 108, 118, in combination with their attachment mechanisms, contribute to the effective transfer of loads within wall assembly 102. The view of FIG. 1 is a side view showing a width of the 2×4 wall frame 104. In general, fabrication of wall assembly 102 includes attaching sheet 118 to base 130, attaching MTS 124 to wall frame 104 prior to attaching wall frame 104 to base 130, and installing drain(s) 122 into openings formed in wall frame 104, all aspects of which are described in FIGS. 2-20 below.

Sheets 108, 118 are configured to wick moisture away from wall frame 104. In one embodiment, sheets 108, 118 are configured to wick moisture by capillary action and are formed of a hydrophilic fiber mat. In one embodiment, the hydrophilic fiber mat is a woven fiber mat of rayon fibers. In one embodiment, the hydrophilic fiber mat is a non-woven fiber mat formed of a random array of mutually-bonded rayon staple fibers. In other embodiments, the hydrophilic fiber web is formed on non-woven fiber forming equipment to have a preferential machine direction that configures the flow of moisture out of wall frame 104.

In one embodiment, MTS 124 is a polymer barrier sheet that forms a barrier to moisture transmission through MTS 124 by diffusion, capillary flow, hydrostatic flow or other penetration mechanisms. Moisture within wall assembly 102 will condense on MTS 124 barrier sheet, for at least the reason that the moisture is prevented from passing through MTS 124. The moisture that condenses on MTS 124 is transported down to sheet 118 and further transported along sheet 118 out of wall assembly 102, where the moisture is removed out of the wall and eventually evaporated. In one embodiment, MTS 124 is formed of a 10 mil polyethylene sheet.

Figure 2:
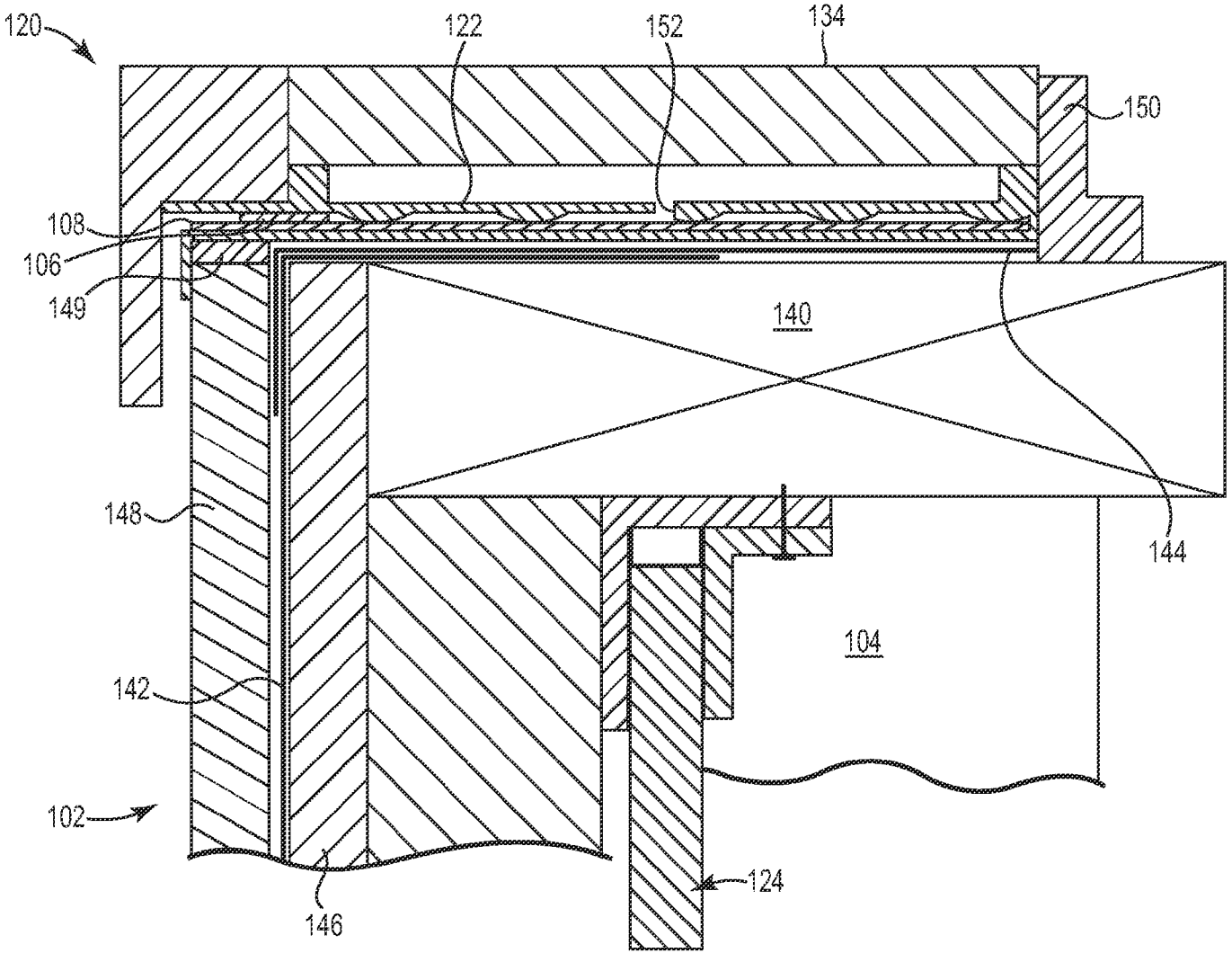
FIG. 2 is a schematic cross-sectional view of a moisture drain disposed in a window opening of the wall assembly illustrated in FIG. 1 according to one embodiment.

FIG. 2 is a schematic cross-sectional view of drain 122 placed in opening 120. Opening 120 is a rough opening sized to receive an envelope penetrating component 134 or EPC 134 (such as a window, a door, an air conditioner, or a vent). Opening 120 is formed within wall frame 104 between, for example, a cross-support 140 fixed between wooden studs. After rough opening 120 is formed, building paper 142 (such as a house wrap material) is attached to an exterior portion of wall assembly 102, a pan flashing 144 is set within rough opening 120, and drain 122 is placed on pan flashing 144 to overhang a sheathing 146 (e.g., oriented-strand board, plywood, or other sheathing material) and siding 148 that form the exterior of wall assembly 102.

Suitable cross-supports 140 include wooden beams such as a 2×4 or 2×6 wood beams attached to wall frame 104. Building paper 142 includes one or more layers of sixty minute grade D building paper or similar vapor permeable house wrap material stretched over and stapled to oriented-strand board 146. In one embodiment, pan flashing 144 is an appropriately formed sheet of thin metal or plastic or similar material that extends about six inches up the sides of studs formed around rough opening 120. Siding 148 includes any suitable cladding material, including vinyl siding, wood siding, aluminum siding, stucco, etc. In one embodiment, a bulk water seal 149 is disposed between drain 122 and siding 148 to minimize the potential for water undesirably entering between drain 122 and opening 120.

Drain 122 is placed into rough opening 120 and attached to cross-support 140 by any suitable attachment means, such as glue, nails, or screws. In one embodiment, EPC 134 is a window 134 is placed into opening 120 and set on drain 122. For ease of illustration, only a jamb portion of window 134 is illustrated resting on drain 122. Window 134 is subject to wind loading and could potentially shift within opening 120. In one embodiment, an interior bracket 150 is attached to cross-support 140 and window 134 to limit motion of window 134 after its installation.

Typically, wall assemblies are constructed in a manner that attempts to prevent moisture entrance. However, forming openings in the wall assembly for doors and windows unavoidably provides a pathway for moisture to enter the wall assembly. As described above, once moisture enters a wall assembly, it is difficult if not impossible to adequately dry the wall assembly. Drain 122 is configured to collect and direct moisture entering through opening 120 along first sheet 108 to a location outside of siding 148. In one embodiment, sheet 108 includes a capillary structure that is configured to wick moisture out of drain 122 to an outside surface of siding 148. Moisture that enters opening 120 is collected by drain 122, directed through drain holes 152 formed in drain 122 that communicate with flexible sheet 108, and subsequently directed along sheet 108 to an exterior of siding 148. In one embodiment, moisture that enters opening 120 that might bypass drain 122 is collected and directed along MTS 124 downward and out of a bottom portion of wall assembly 102.

Figure 3:
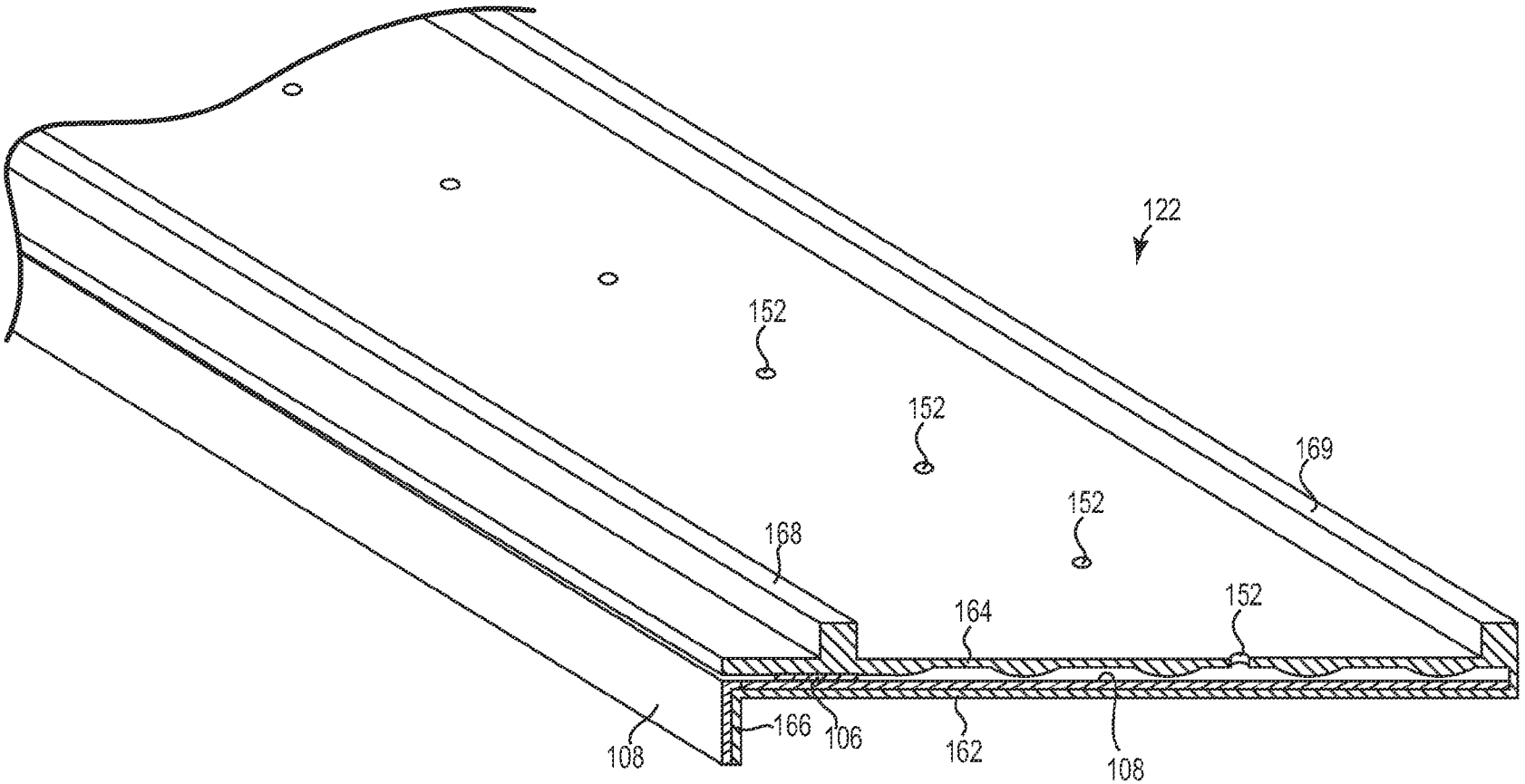
FIG. 3 is a perspective view of the window drain illustrated in FIG. 2 according to one embodiment.
Figure 4:
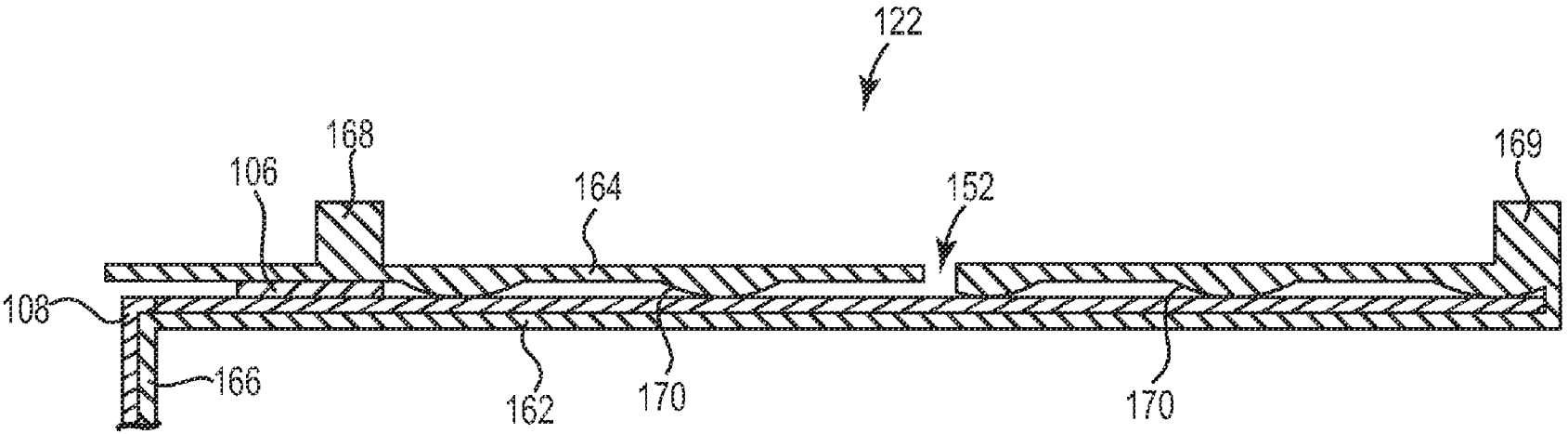
FIG. 4 is a schematic cross-sectional view of the moisture drain illustrated in FIG. 2 according to one embodiment.

FIG. 3 is a perspective view and FIG. 4 is a cross-sectional view of drain 122 according to one embodiment. Drain 122 includes a bottom plate 162 spaced apart form a top plate 164 with flexible sheet 108 disposed between plates 162, 164. In one embodiment, bottom plate 162 includes an angled flange 166 and flexible sheet 108 is attached to bottom plate 162 and a portion of angled flange 166. In this manner, moisture that is wicked along flexible sheet 108 is directed out of drain 122 and downward along angled flange 166.

In one embodiment, top plate 164 includes drain holes 152 and a first footing 168 spaced from a second footing 169. Holes 152 are formed in top plate 164 to enable water captured by the drain 122 to seep into flexible sheet 108 for transport out of drain 122. In one embodiment, a row of holes 152 is provided in top plate 164. In other embodiments, an array of holes or an open grid or screen-like pattern of holes 152 is formed in top plate 164 to enable water collected by drain 122 to flow down to flexible sheet 108. Footings 168, 169 extend from an exterior surface of top plate 164 and are configured to support a bottom jamb of window 134 or EPC 134 (FIG. 2).

In one embodiment, drain 122 is extruded or molded as a single integral piece into which flexible sheet 108 and seal 106 are subsequently inserted. In one embodiment, bottom plate 162 and top plate 164 are extruded from plastic material such as polyethylene or polyvinyl chloride (PVC). Some window openings are formed to a standard size such as 36 inches wide or 48 inches wide or other standard width. In one embodiment, drain 122 is prefabricated in a molded form to fit in a standard width window and includes molded and sealed end caps formed on opposing lateral ends of drain 122. For example, for a standard width window opening of 36 inches, one embodiment of drain 122 includes integrally formed top and bottom plates 162, 164 extending about 36 inches between sealed end caps. In other embodiments, drain 122 is provided as an integral length of material several feet in length (on a roll, for example) and a desired length of drain 122 is selectively cut by a building contractor depending upon the window size/application.

Seal 106 is disposed between flexible sheet 108 and top plate 164 to prevent or limit ingress of bulk water into drain 122. With additional reference to FIG. 2, drain 122 provides a double seal between top plate 164 and wicking sheet 108 including seal 106 disposed between sheet 108 and top plate 164 and bulk water seal 149 disposed between drain 122 and siding 148. This double seal provides a hydrodynamic seal to prevent wind-driven rain from entering under a window placed into opening 102. In addition, seal 106 enables liquid to be transported under/through seal 106 from drain 122 to the exterior of cladding 148. Thus, drain 122 is configured to drain moisture to the exterior of wall assembly 102 while preventing ingress of wind-driven rain or other bulk water.

In one embodiment, an inside surface of top plate 164 includes pressure distribution bumps 170 that are configured to distribute the load applied to drain 122 by EPC 134 (FIG. 2). Bumps 170 are distributed along a bottom surface of top plate 164 in a pattern or array that enables liquid flow within sheet 108 along the full length and width of flexible sheet 108.

Embodiments of drain 122 enable and provide for the drainage of water from beneath the window jamb to the exterior of the cladding 148. In contrast, the known assemblies drain water from beneath the window jamb to a location between a permeable exterior sheath (house wrap) and the exterior cladding, which has the potential to rot the cladding or give rise to the growth of mold. Thus, the embodiments of drain 122 provide a significant and measurable advantage in moisture removal from sealed exterior wall assemblies over the art.

Figure 5:
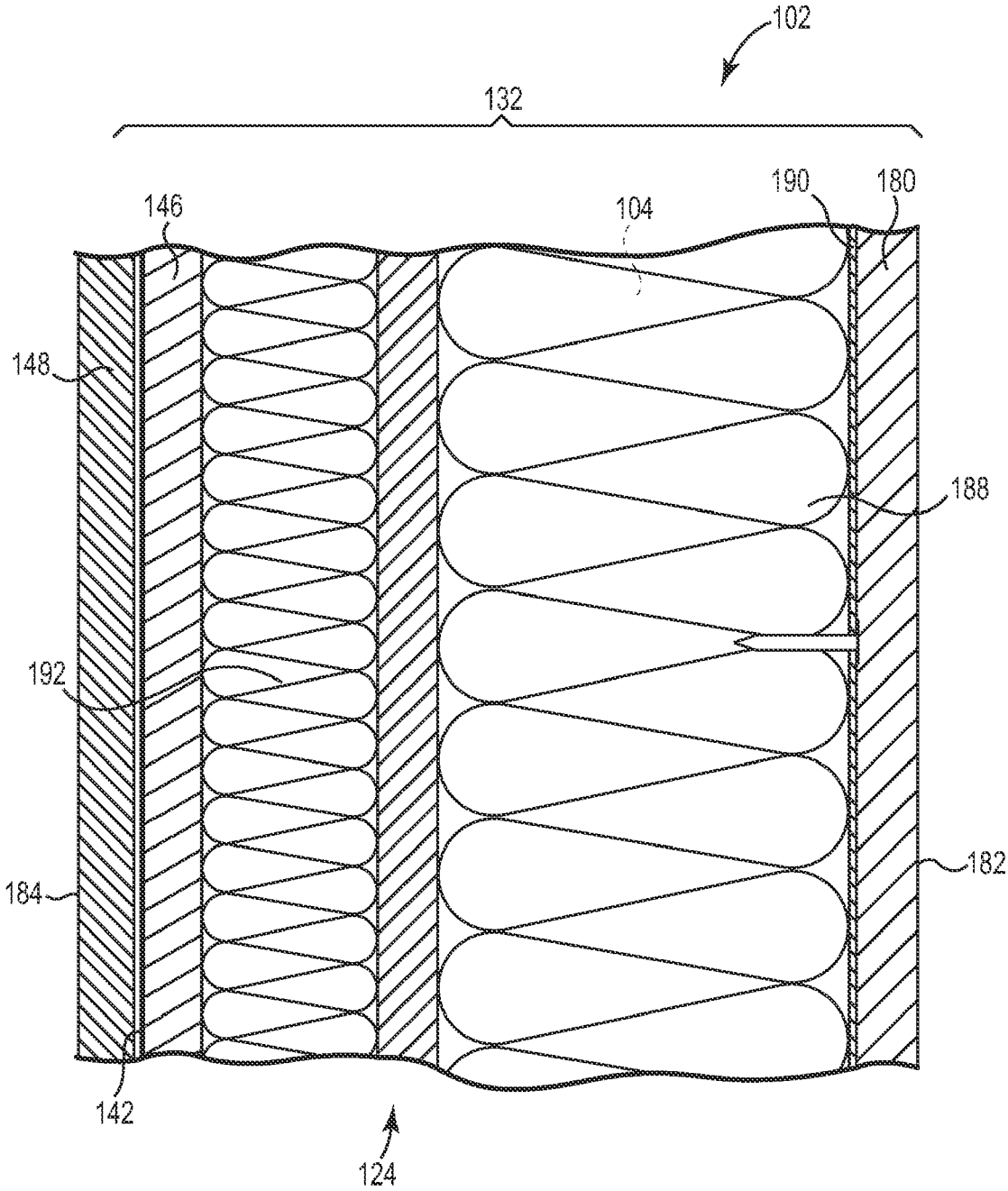
FIG. 5 is a schematic cross-sectional view of an insulated section of the wall assembly illustrated in FIG. 1 including a moisture transport spacer according to one embodiment.

FIG. 5 is a schematic cross-sectional view of insulated section 132 of wall assembly 102 according to one embodiment. In general, wall frame 104 supports an interior wall layer 180 defining an interior side 182 and siding 148 that defines an exterior side 184 opposite interior side 182. In one embodiment, wall frame 104 is fabricated from 2×4 studs having a first insulation 188 disposed between adjacent studs with a first membrane 190 attached to an interior side of frame 104 between interior wall layer 180 and frame 104. In one embodiment, MTS 124 is attached along an exterior side of frame 104 and wall assembly 102 includes a second insulation 192 disposed between MTS 124 and oriented-strand board 146 or other suitable sheathing to which siding 148 is attached. FIG. 5 illustrates one embodiment of insulated section 132, but it is to be understood that additional house wrap layers or other membranes can be suitably fastened between siding 148 and oriented-strand board 146 depending upon the construction application.

In one embodiment, interior wall layer 180 is a gypsum sheet configured to be nailed or screwed into wall frame 104. Siding 148 is typically a weather resistant board and includes any suitable form of exterior building siding including aluminum siding, vinyl siding, wood siding, stucco or the like. In one embodiment, an exterior vapor permeable barrier 142 is disposed between oriented-strand board 146 and siding 148, where the exterior vapor permeable barrier 142 allows moisture vapor on the exterior side of MTS 124 to dry to the exterior side of wall assembly 102.

In one embodiment, first insulation 188 is R-13 fiberglass insulation, although other suitable forms of insulation are also acceptable. In one embodiment, first membrane 190 is a vapor permeable polyamide membrane such as a 2 mil thick PA-6 membrane having humidity-dependent permeability or other suitable home construction membranes with similar vapor permeable characteristics. First membrane 190 is configured to allow moisture vapor on the interior side of MTS 124 to dry to the interior side of wall assembly 102. In one embodiment, second insulation 192 is an extruded polystyrene insulation having a thickness of about 1.5 inches. In one embodiment, oriented-strand board 146 is 0.5 inches thick as typically employed in the building construction industry.

In one embodiment, exterior vapor permeable barrier 142 is attached to an exterior of sheathing 146, first membrane 190 is a vapor permeable warm side vapor retarder attached to interior wall layer 180, and MTS 124 is disposed between vapor permeable barrier 142 and vapor permeable warm side vapor retarder 190.

In on embodiment, insulated section 132 is tightly constructed to prevent drafts or heat loss through wall assembly 102. Temperature gradients across insulated section 132 have the potential to create moisture condensation on one or more layers of wall assembly 102. In one embodiment, MTS 124 includes a film that forms a substantial barrier to the passage of air and moisture vapor through MTS 124. This film barrier to the passage of moisture also provides a surface onto which moisture condensate will naturally form. In one embodiment, MTS 124 includes one or more surfaces configured to transport the moisture condensate by capillary action vertically along (e.g., downward) wall frame 104 for eventual exit from wall frame assembly 102.

In contrast to conventional wall assemblies, wall assembly 102 includes a film within MTS 124 that is a barrier against both the passage of air and the passage of moisture vapor carried in the air, and thus provides a barrier for wall assembly 102. MTS 124 provides a surface that traps and collects moisture within wall assembly 102 and a wicking mechanism that directs the moisture away from wall frame 104 and out of wall assembly 102, which is contrary to the conventional approach to fabricating wall assemblies.

It has been discovered that the R-value of insulation 192 and the ratio of the R-values between the insulation 188 and insulation 192 relates to the successful operation of system 102. The principle is to place MTS 124 where the sensible temperature on the interior surface of MTS 124 is less than the dew point temperature in the heating season so that condensation will form on the interior surface of MTS 124 where it is eventually removed from wall assembly 102 by sheet 118. Conversely, during the cooling season, the sensible temperature on the exterior surface of MTS 124 is less than the dew point temperature allowing exterior sourced vapor to condense on the exterior surface of MTS 124, where it is likewise removed from wall assembly 102 by sheet 118.

In one embodiment, the ratio of interior insulation R-value to exterior insulation R-value is 1.73 and is so selected to permit the favorable dew points in the heating and cooling seasons to occur on the interior and exterior surfaces of MTS 124, respectively.

In one embodiment, MTS 124 is positioned within the insulation such that the temperature on the interior condensing surface is less than the dew point temperature in the heating season, and the temperature on the exterior condensing surface is less than the dew point temperature in the cooling season.

Embodiments of MTS 124 and other embodiments of moisture transport spacers described herein are compatible with any internal sheathing, any external sheathing, and any external cladding suited for use in insulated external wall assemblies.

Figure 6:
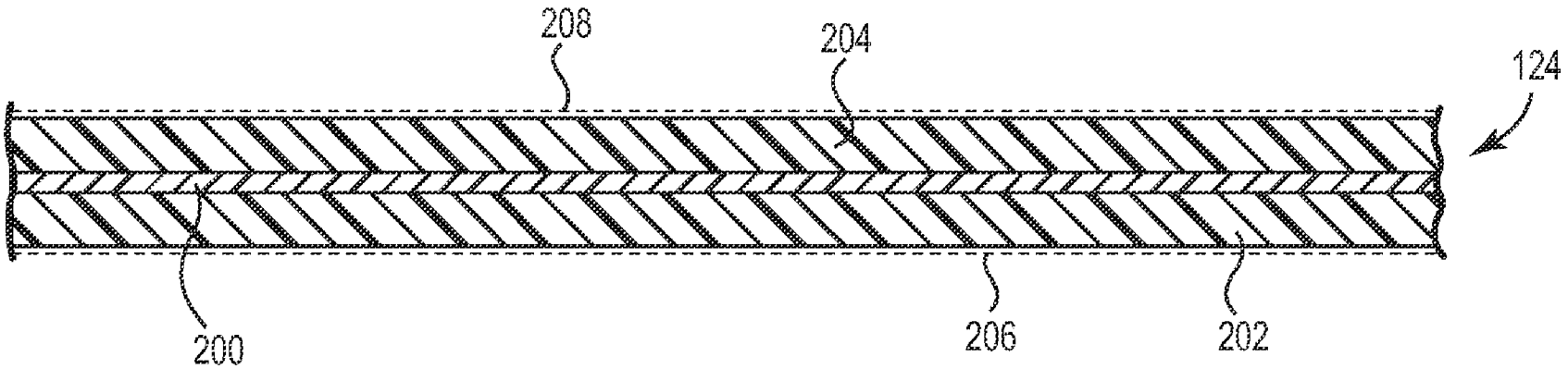
FIG. 6 is a schematic cross-sectional view of the moisture transport spacer illustrated in FIG. 5 according to one embodiment.

FIG. 6 is a schematic cross-sectional view of MTS 124 according to one embodiment. In one embodiment, MTS 124 includes a film 200, a first moisture wicking layer 202 (MWL 202) disposed on a first side of film 200 and a second moisture wicking layer 204 (MWL 204) disposed on an opposing second side of film 200.

In one embodiment, MTS 124 includes mold preventing additives and/or a suitable flame retarding additive. In one embodiment, MTS 124 is fabricated from recyclable material(s).

In one embodiment, film 200 forms a substantial barrier to the passage of air and moisture vapor through MTS 124 and is a polymer film having a caliper of 0.010 inches (e.g., 10 mil film). Suitable polymer films include polyolefin, polyethylene, or polypropylene, as examples. In one exemplary embodiment, film 200 is a 10 mil polyethylene membrane configured to form a substantial barrier to the passage of air and moisture vapor through MTS 124. In one embodiment, film 200 is a substantially flat uniform-caliper film, although structured films as described below are also acceptable.

MWL 202 and 24 are configured to wick moisture away from film 200. In one embodiment, MWL 202 and 24 are configured to wick moisture away from film 200 by capillary action and are formed of a hydrophilic fiber mat. In one embodiment, the hydrophilic fiber mat is a woven fiber mat of rayon fibers. In one embodiment, the hydrophilic fiber mat is a non-woven fiber mat formed of a random array of mutually-bonded rayon staple fibers. In other embodiments, the hydrophilic fiber web is formed on non-woven fiber forming equipment to have a preferential machine direction that configures the flow of moisture along MWL 202, 204 to be uni-directional (for example, the moisture flows longitudinally along MWL 202, 204 which is vertical relative to wall assembly 202 as illustrated in FIG. 1).

MTS 124 optionally includes a first mesh 206 attached to MWL 202 and a second mesh 208 attached to MWL 204. Meshes 206, 208 are configured to maintain a useful level of bending stiffness that assists in handling MTS 124 when placing it against wall frame 104 (FIG. 5) during construction of wall assembly 102. In one embodiment, meshes 206, 208 are configured to prevent loose fiber insulation material such as fiberglass batts from clogging the drainage cavities In one embodiment, MTS 124 is approximately 0.5 inches thick, including the 10 mil polymer film 200 and about ¼ inch thick sections for each of MWL 202 and MWL 204. Suitable meshes 206, 208 include nettings or other open materials that assist in keeping MWL 202, 204 in place for handling when attaching MTS 124 to wall frame 104.

Figure 7:
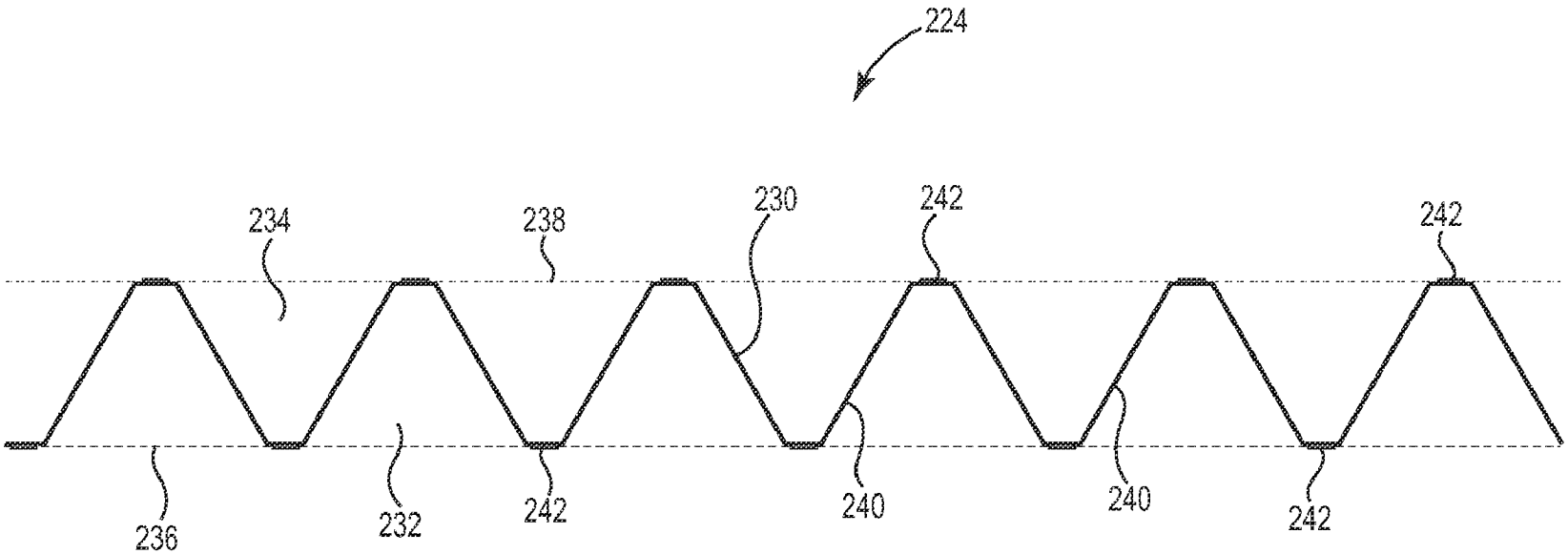
FIG. 7 is a schematic cross-sectional view of another embodiment of the moisture transport spacer illustrated in FIG. 5.
Figure 8B:
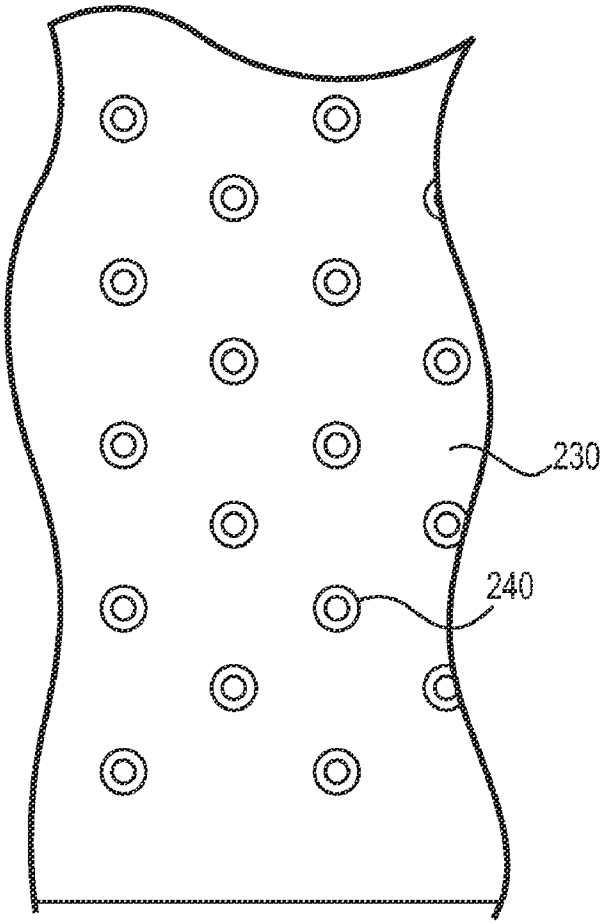
FIGS. 8A-8B are top views of two embodiments the moisture transport spacer illustrated in FIG. 7.
Figure 8A:
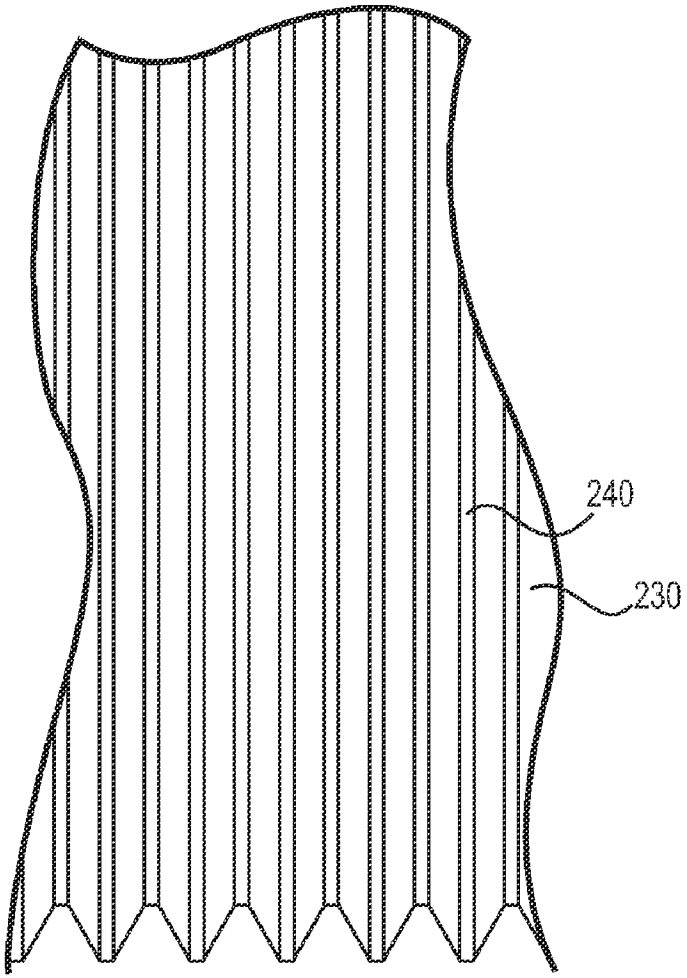

FIG. 7 is a schematic cross-sectional view of another embodiment of a moisture transport spacer 224 (MTS 224). In one embodiment, MTS 224 includes a structured film 230, a first moisture wicking layer 232 (MWL 232) disposed on a first side of film 230, and a second moisture wicking layer 234 (MWL 234) disposed on an opposing side of film 230. In one embodiment, structured film 230 includes a plurality of discrete troughs 240 as illustrated in FIG. 8A. In one embodiment, structured film 230 includes a plurality of discrete cones 240 as illustrated in FIG. 8B. MWL 232, 234 are packed in the troughs 240 or around the array of cones 240 and held in place by opposing meshes 236, 238 that are bonded to peaks 242 of the structure. In one embodiment, MWL 232, 234 are attached to film 230, for example by pneumatically spraying MWL 232, 234 and an adhesive component onto film 230.

FIG. 8A is a top view of troughs 240 formed in film 230 and FIG. 8B is a top view of discrete cones 240 formed in film 230 according to various embodiments. In one embodiment, film 230 is provided as a corrugated sheet of a polymer configured to form a substantial barrier to the passage of air and moisture vapor. One suitable polymer includes polyvinyl chloride, although other film materials are also acceptable.

In one embodiment, troughs 240 are provided as continuous longitudinal troughs extending along film 230 and are configured to capture and transport moisture down the troughs 240. In one embodiment, troughs 240 are at least partially filled with MWL 232, 234 that combine with troughs 240 to assist in transporting moisture along film 230.

In one embodiment, film 230 includes an array of cones 240 formed laterally across film 230 as illustrated in FIG. 8B. Cones 240 provide increased surface area for film 230, which provides a greater area for the formation of condensation as humid air comes into contact with film 230. Peaks 242 of cones provide a depth for film 230, which forms a spacing between wall frame 104 and second insulation 192 (FIG. 5) when MTS 224 is installed in wall assembly 102.

MWL 232, 234 are similar to MWL 202, 204 as described in FIG. 6 and include a mat of water-wettable or hydrophilic fibers configured to wick moisture along MTS 224, whether along troughs 240 or between the array of cones 240.

Figure 9:
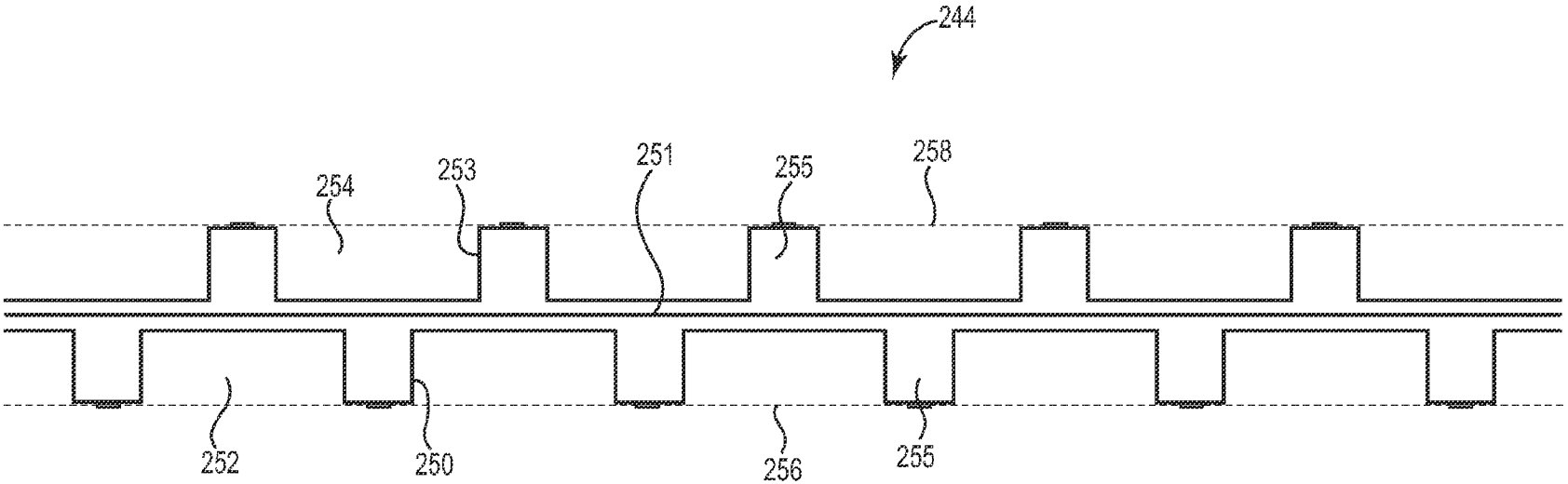
FIG. 9 is a schematic cross-sectional view of another embodiment of the moisture transport spacer illustrated in FIG. 5.

FIG. 9 is a schematic cross-sectional view of another embodiment of a moisture transport spacer 244 (MTS 244). In one embodiment, MTS 244 includes a first uni-directional dimpled sheet 250 attached to a center film 251 and a second uni-directional dimpled sheet 253 attached to an opposing side of center film 251. Uni-directional dimpled sheets 250, 253 each provide dimples 255 oriented to project away from center film 251. A first moisture wicking layer 252 (MWL 252) is disposed between adjacent dimples 255 along dimpled film 250, and a second moisture wicking layer 254 (MWL 254) is disposed between adjacent dimples along dimpled film 253.

In one embodiment, the three-part laminate formed by dimpled films 250, 253 attached to center film 251 is configured to form a substantial barrier to the through-passage of air and moisture vapor, and MWL 252, 254 are configured to transport/remove moisture captured by the three-part laminate.

In one embodiment, dimpled films 250, 253 include an ordered array of dimples 255 disposed along films 250, 253. In one embodiment, dimpled films 250, 253 include a staggered array of dimples 255 disposed along films 250, 253.

MWL 252, 254 are similar to MWL 202, 204 as described in FIG. 6 and include a mat of water-wettable or hydrophilic fibers configured to wick moisture along MTS 244. In one embodiment, MWL 252, 254 are configured to wick moisture along MTS 244 by capillary action.

In one embodiment, a first open mesh 256 is attached to dimples 255 along film 250 and a second mesh 258 is attached to dimples 255 along film 253. Meshes 256, 258 are similar to meshes 206, 208 described above and are configured to assist in handling MTS 244.

Figure 10:
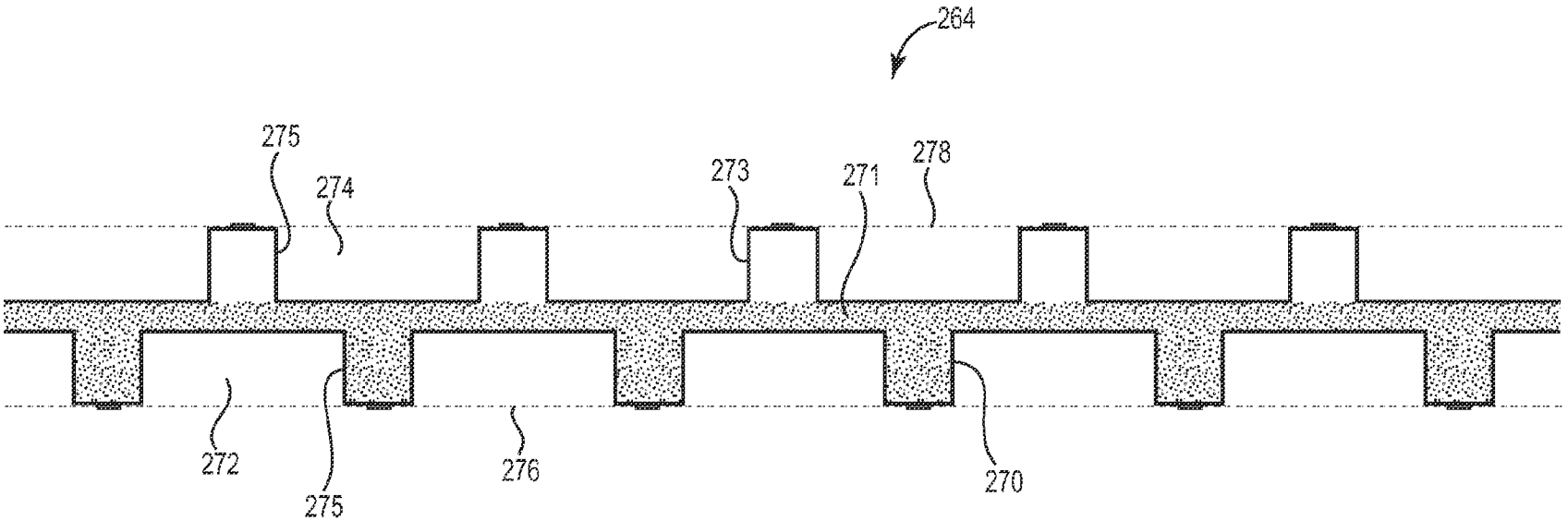
FIG. 10 is a schematic cross-sectional view of another embodiment of the moisture transport spacer illustrated in FIG. 5.

FIG. 10 is a schematic cross-sectional view of another embodiment of a moisture transport spacer 264 (MTS 264). In one embodiment, MTS 264 includes a two-part laminate of uni-directional sheets including a first uni-directional dimpled film 270 attached to a second uni-directional dimpled film 273 by an adhesive 271. In one embodiment, adhesive 271 fills the pockets or cavities that are formed on a back side of dimples 275 in dimpled film 270, and second uni-directional dimpled film 273 is attached to adhesive 271. In a manner similar to MTS 244 (FIG. 9), a first moisture wicking layer 272 (MWL 272) is disposed between adjacent dimples 275 along first film 270, and a second moisture wicking layer 274 (MWL 274) is disposed between adjacent dimples 275 of second film 273. Opposing open meshes 276, 278 are bonded to the peaks of dimples 275 to retain MWL 272, 274 within dimples 275 and facilitate handling of MTS 264. Films 270, 273 are configured to provide a substantial barrier to the passage of water and moisture vapor through MTS 264, and MWL 272, 274 are configured to transport moisture and/or condensate away from films 270, 273. In one embodiment, the two part assembly of MTS 264 provides a continuous bulk water seal along its edges that is configured to prevent bulk water movement.

Figure 11:
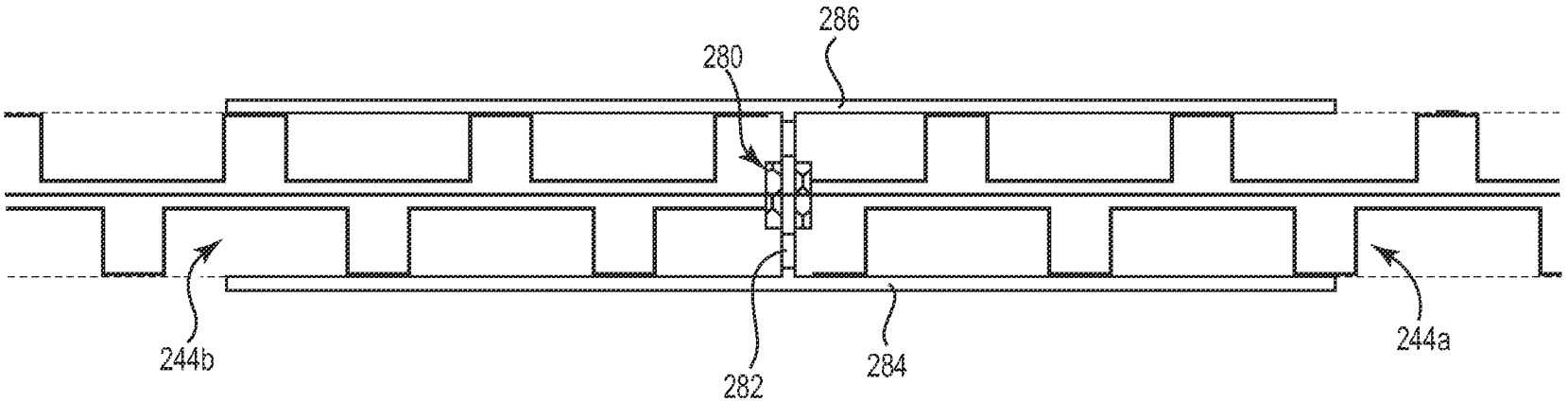
FIG. 11 is a schematic cross-sectional view of two sections of the moisture transport spacer illustrated in FIG. 10 bonded together according to one embodiment.

FIG. 11 is a schematic cross-sectional view of a bond 280 formed between a first segment 244*a* of MTS 244 and a second segment 244*b* of MTS 244. With additional reference to FIG. 5, the moisture transport spacers/sheets described herein are desirably provided in sections that are sized for convenient handling, for example having a width of between about 2-6 feet. During construction of a wall, the moisture transport sheet is attached to frame 104 in segments until the area of frame 104 is covered to ensure that the entire height of insulated section 132 is covered by a portion of the moisture transport sheet. With this in mind, it is desirable to provide a mechanism for attaching first segment 244*a* of MTS 244 to second segment 244*b* of MTS 244 in a manner that maintains the barrier function of the moisture transport sheet.

In one embodiment, first section 244*a* of MTS 244 is sealed to the second section 244*b* of MTS 244 along a common edge 282 by bond 280. In one embodiment, bond 280 is suitably formed by a foam seal mat extending along common edge 282 or by an adhesive caulk deposited along common edge 282. In one embodiment, additional sealing support is provided across the union formed along common edge 282 by a first tape 284 attached and extending on either side of bond 280 and a second opposing tape 286 attached and extending on either side of bond 280.

Similar bonding methodologies are applied to achieve a bond for one or more of MTS 124, 224, or 264 as described above. Bond 280 is acceptably formed prior to inserting MTS 244 into wall assembly 102 (FIG. 5). However, bond 280 is also compatible with attaching a first segment of the moisture transport sheet to a second segment of the moisture transport sheet after the moisture transport sheet is attached to frame 104.

Figure 12A:
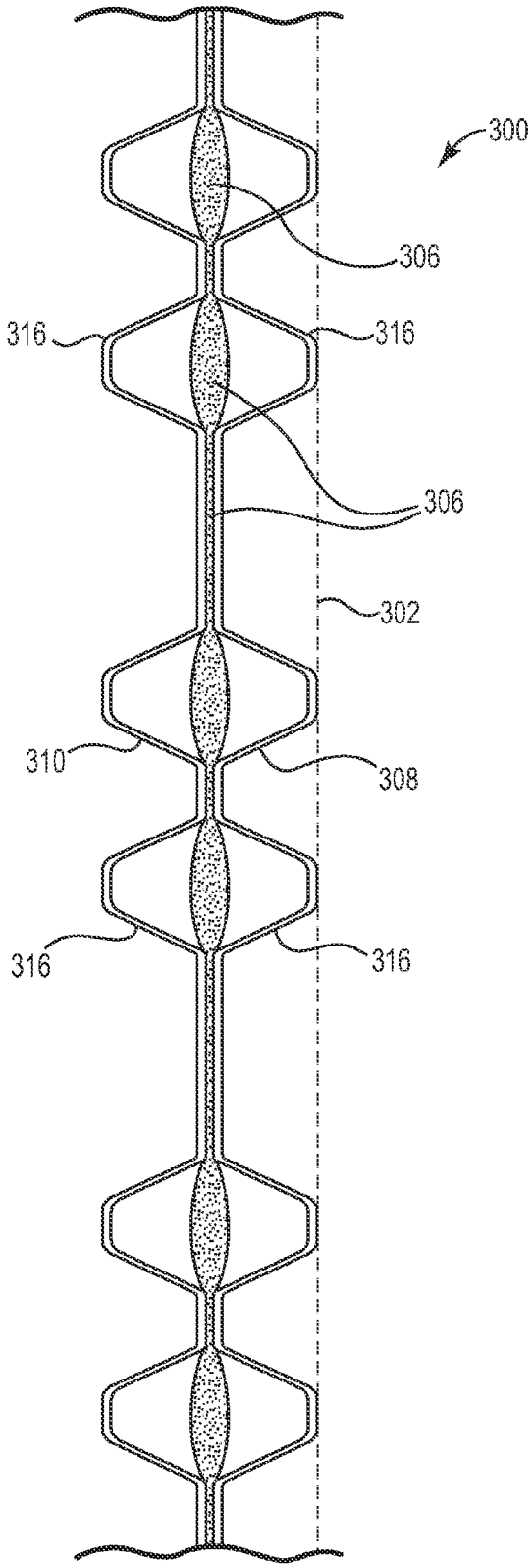
FIG. 12A is a schematic cross-sectional view of another embodiment of the moisture transport spacer illustrated in FIG. 5.

FIG. 12A is a schematic cross-sectional view of another embodiment of a moisture transport spacer 300 (MTS 300). In one embodiment, MTS 300 includes an adhesive 306 bonding a first dimpled sheet 308 to a second opposing dimpled sheet 310, and a scrim 302 attached to one of the dimpled sheets 308, 310. Adhesive 306 attaches first dimpled sheet 308 to second dimpled sheet 310, and scrim 302 is provided to prevent fiberglass-based insulation from impeding moisture flow along the dimpled sheets 308, 310 that it is attached to. Dimpled sheets 308, 310 provide an air and moisture barrier that prevents moisture from passing through MTS 300. In one embodiment, adhesive 306 forms a continuous surface at the edges of MTS 300, which minimizes the possibility that bulk water will bypass a junction formed where a flat portion of one sheet is juxtaposed to a cone portion of a second sheet.

In one embodiment, sheets 308, 310 are polymer films that are attached in a back-to-back arrangement such that opposing dimples 316 are oriented to project outward. In one embodiment, MTS 300 is provided as a flexible profiled sheet having an array of protrusions (e.g., dimples 316) formed to project away from at least one major surface of the sheet. The dimples 316 are provided as a profiled pattern of round protrusions projecting about ¼ inch outward to define a dimpled drainage plane, where the protrusions are formed in an ordered array on each exterior surface of films 308, 310. In one embodiment, scrim 302 is a nylon mesh that is attached to dimples 316 on one of the dimpled films 308, 310.

When MTS 300 is assembled into wall assembly 102 (FIG. 5), scrim 302 is oriented to face toward fiberglass insulation 188 and the drainage planes provided by dimpled sheets 308, 310 are configured to enable moisture accumulated on the surface of each of the sheets 308, 310 to cascade down between the dimples 316 under the force of gravity.

Figure 12B:
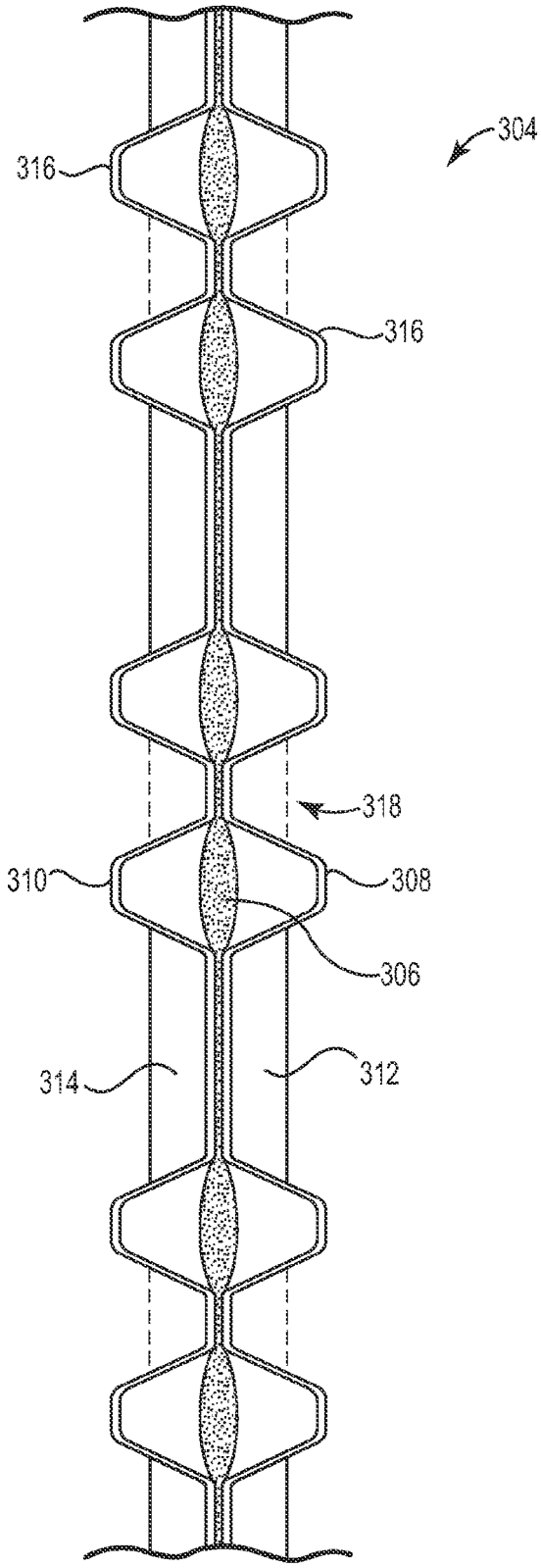
FIG. 12B is a schematic cross-sectional view of another embodiment of the moisture transport spacer illustrated in FIG. 5.

FIG. 12B is a schematic cross-sectional view of another embodiment of a moisture transport spacer 304 (MTS 304) including a fiber-based wicking layer. In one embodiment, MTS 304 includes adhesive 306 bonding first dimpled film 308 to second opposing dimpled film 310, with a first wicking layer 312 attached to first film 308 and a second wicking layer 314 attached to second film 310. In one embodiment, adhesive 306 and films 308, 310 combine to configure MTS 304 as an air and moisture vapor barrier, and wicking layers 312, 314 are provided to transport moisture that that condenses on or is collected by films 308, 310. In one embodiment, a section 318 of MTS 304 has a portion of wicking layers 312, 314 removed to provide a demarcation or zone that facilitates splicing and bonding segments of MTS 304.

In one embodiment, adhesive 306 is provided as a soft, repositionable adhesive configured to removably attach first dimpled film 308 to second dimpled film 310. Adhesive 306 is suitable applied to interior surfaces of films 308, 310. In one embodiment, adhesive 306 is provided as a sheet of adhesive pressed between films 308, 310.

In one embodiment, films 308, 310 are formed from a polymer to have a caliper between about 4-14 mils thick and are structured to provide opposing dimples 316 that are formed in an ordered array on each exterior surface of films 308, 310. In one embodiment, dimples 316 are disposed in a staggered array across surfaces of films 308, 310, although aligned linear arrays of dimples 316 are also acceptable.

Wicking layers 312, 314 are similar to wicking layers 202, 204 (FIG. 6) described above. Generally, wicking layers 312, 314 are fabricated to provide capillary wicking of moisture along films 308, 310. One suitable material for forming wicking layers 312, 314 includes a non-woven sheet of rayon staple fiber formed to have a basis weight of 2.8 ounces with a 0.4 mm thickness.

Figure 13:
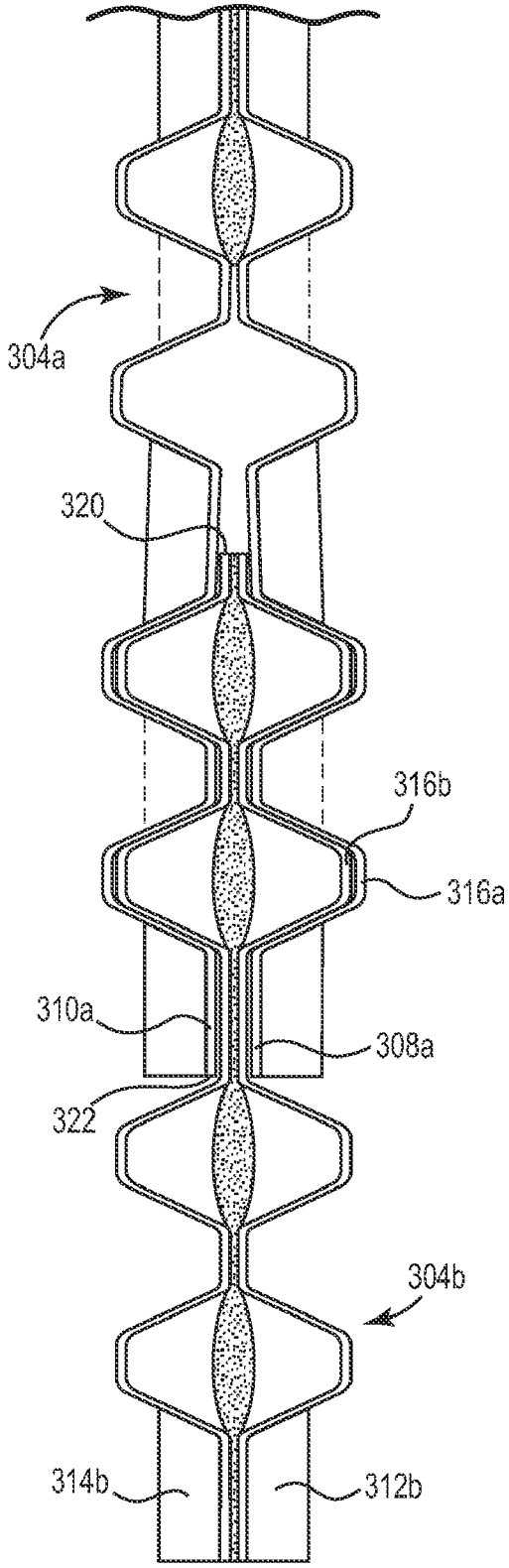
FIG. 13 is a schematic cross-sectional view of two segments of the moisture transport spacer illustrated in FIG. 12B bonded together according to one embodiment

FIG. 13 is a schematic cross-sectional view of a first section 304*a* of MTS 304 spliced over and bonded to a second section 304*b* of MTS 304. In one embodiment, a leading edge 320 of second section 304*b* has been spliced along splicing section 318 (FIG. 12B) and a portion of wicking layers 312*b*, 314*b* has been removed from second section 304*b*. A leading end 322 of first section 304*a* is plied apart such that first film 308*a* is separated from second film 310*a*. Separated films 308*a*, 310*a* are deposited over exterior surfaces of second section 304*b* to mate dimples 316 on each section 304*a*, 304*b* together. In this manner, a sealed joint between first section 304*a* and second section 304*b* of MTS 304 is formed that maintains the barrier properties of MTS 304.

The above-described mating of sections 304*a*, 304*b* does not require hand tools (apart from a scissors) and results in a durable seal between the sections 304*a*, 304*b* without the use of additional layers of tapes/adhesives. In addition, the resulting thickness of the combined two segments 304*a*, 304*b* is similar to the original thickness of MTS 304.

Figure 14:
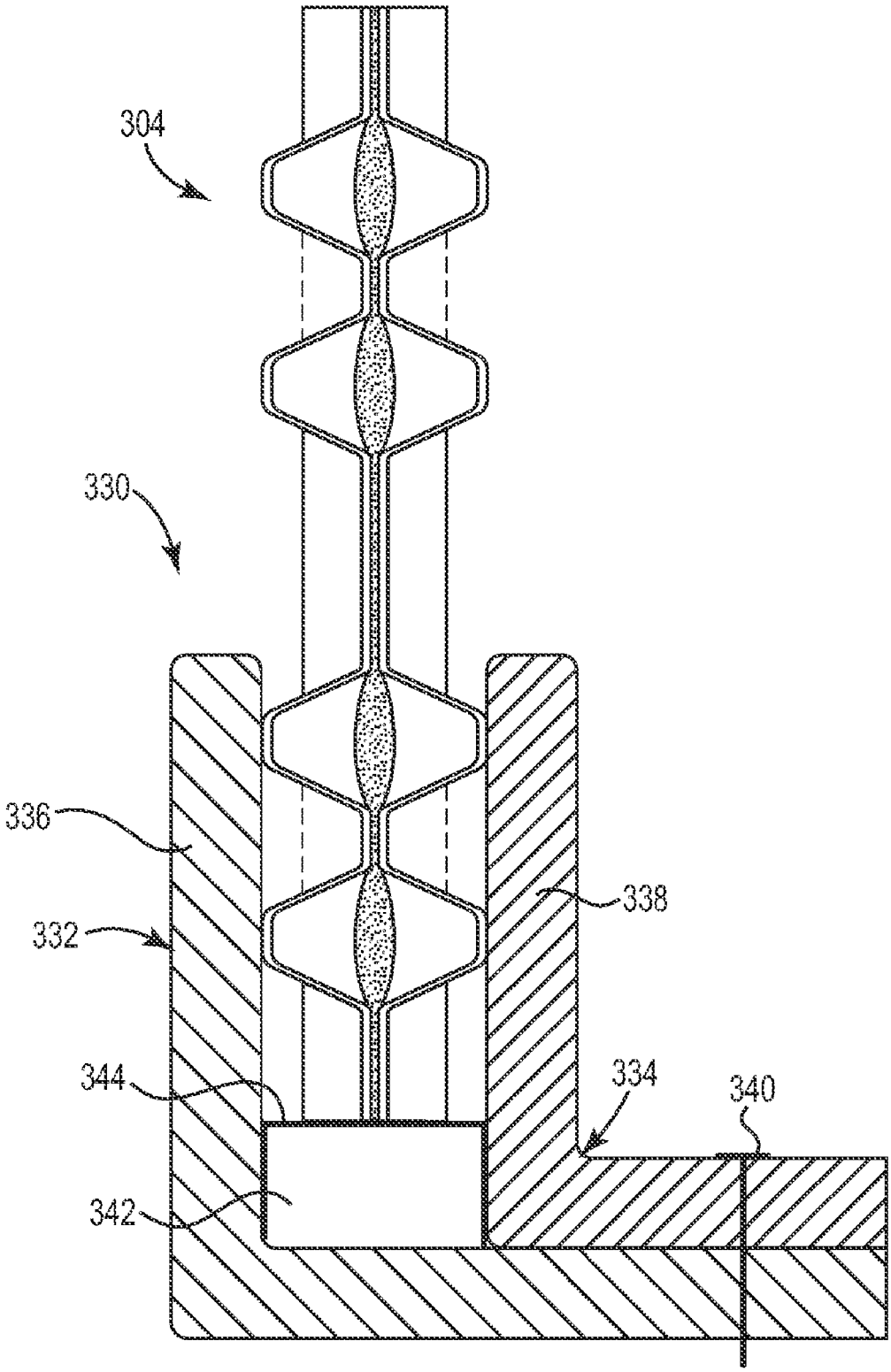
FIG. 14 is a schematic cross-sectional view of the moisture transport spacer illustrated in FIG. 12B retained in a rough opening edge seal according to one embodiment.

FIG. 14 is a schematic cross-sectional view of an edge seal 330 configured to retain ends of MTS 304 according to one embodiment. MTS 304 is attached to wall frame 104 (FIG. 5) from a location adjacent to a top edge of the wall down to a location adjacent to a bottom edge of the wall. It is desirable to provide the contractor with an easy-to-use mechanism that will retain and seal the ends/edges of MTS 304 (and the other moisture transport sheets described herein) as wall assembly 102 is erected. Since wall frame sizes can vary in width and height, in one embodiment edge seal 330 is provided as a rough opening edge seal 330 that is selectively cut to fit the size of the wall frame being erected.

In one embodiment, edge seal 330 includes a first angled flange 332 and a second angled flange 334 that is adjustable relative to and attachable to first angled flange 332. Edge seal 330 is configured for use along the edges of wall frame 104 (FIG. 5). During assembly, first angled flange 332 is placed against wall frame 104 and MTS 304 is pressed against an upright 336 of angled flange 332. Second angled flange 334 slid over first angled flange 332 until upright 338 sandwiches MTS 304 against upright 336. MTS 304 is thus retained in place between uprights 336, 338 and a fastener 340 is subsequently secured to hold first and second angled flanges 332, 334 in the desired orientation.

In one embodiment, angled flange 332 has a height of about 1.5 inches with a thickness of about 3/16 inches, and angled flange 334 has a height of about 1.25 inches with a thickness of about 3/16 inches. In one embodiment, angled flanges 332, 334 are formed from plastic. Suitable plastics for forming edge seal 330 include polyolefins, nylon, polyester, polyvinyl chloride or other plastics.

One advantage of rough opening edge seal 330 is that second angled flange 334 can be selectively pressed against MTS 304 to provide a desired amount of pressure sandwiching 304 between angled flanges 332, 334. In on embodiment, it is desirable to seal MTS 304 within wall assembly 102 (FIG. 5), and a seal strip 342 is provided that is attached between flanges 336, 338 to provide a moisture seal around the edges of MTS 304. In on embodiment, seal strip 342 is formed of a foam rubber having a thickness of about 0.25 inches and including an adhesive barrier seal 344 on an exterior surface. In one embodiment, one or more exterior surfaces of seal strip 342 include an exposed adhesive surface that attaches seal strip 342 to rough opening edge seal 330.

Figure 15:
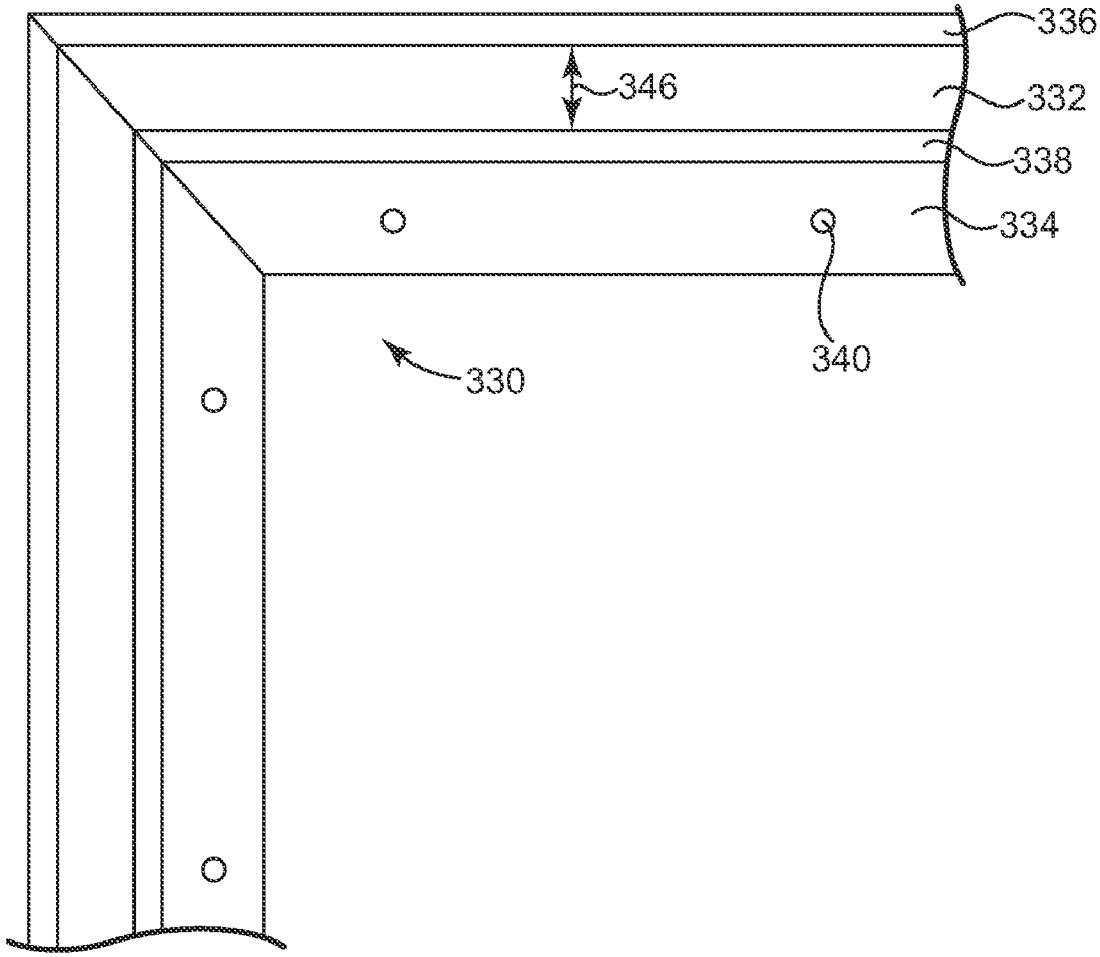
FIG. 15 is a top view of the rough opening edge seal illustrated in FIG. 14 according to one embodiment.

FIG. 15 is a top view of edge seal 330 according to one embodiment. Edge seal 330 includes linear segments suited for placement along lateral edges of wall assemblies and corner segments suited for placement along corners of abutted wall frames. FIG. 15 illustrates a corner segment for a rough opening inside edge seal 330 including second angled flange 334 placed on top of first angled flange 332 such that uprights 336, 338 are spaced apart to provide an opening 346 to receive MTS 304 (FIG. 14). The width of opening 346 between uprights 336, 338 is varied by selectively positioning second angled flange 334 a desired distance from first angled flange 332 before fixing it in place with fastener 340.

Figure 16:
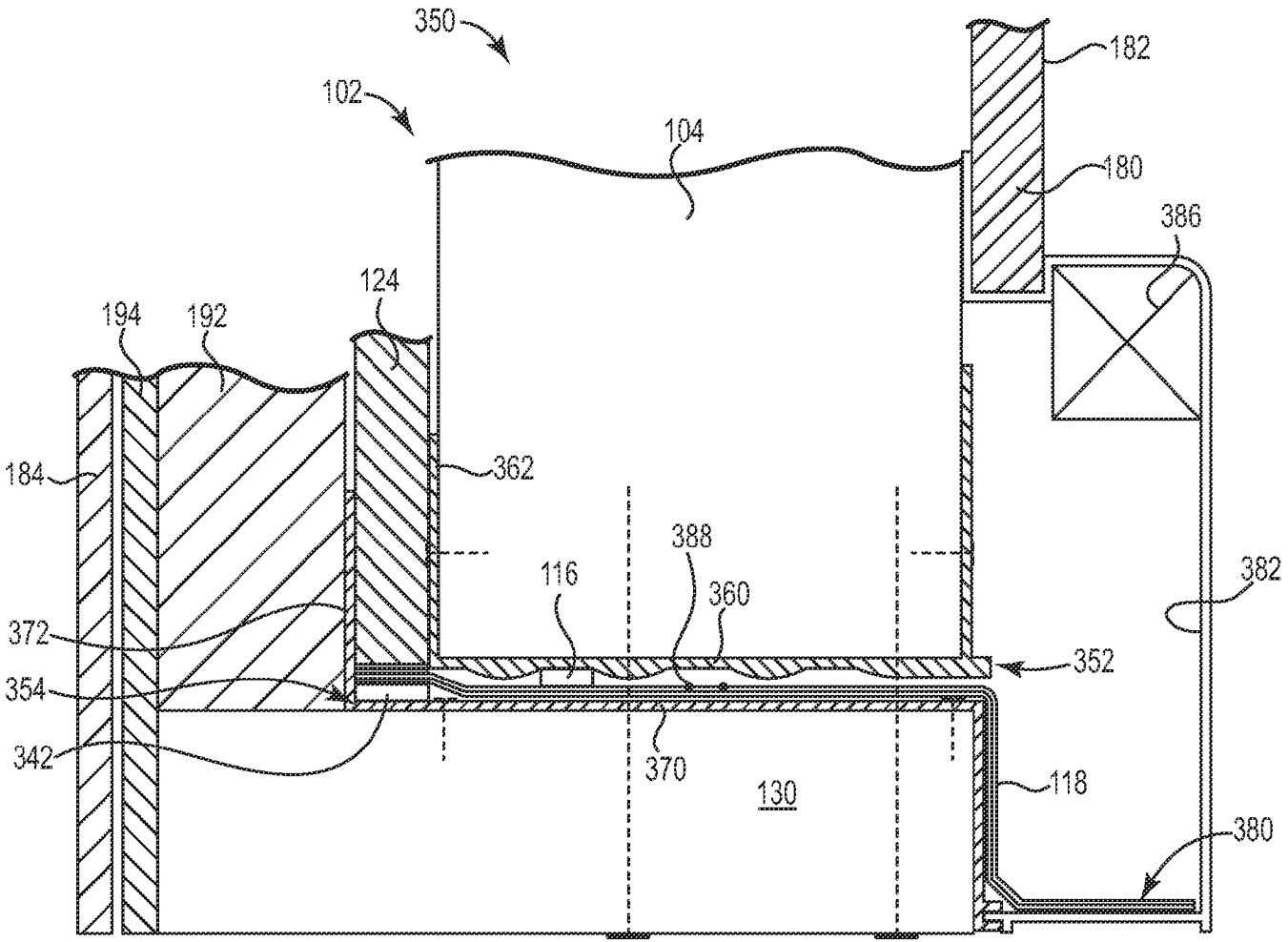
FIG. 16 is a schematic cross-sectional view of a system of components for erecting an exterior wall assembly according to one embodiment.

FIG. 16 is a schematic cross-sectional view of a system 350 of components for erecting an exterior wall assembly according to one embodiment. With additional reference to FIG. 1 and FIG. 5, system 350 includes a stud cap 352 attachable to wall frame 104 and a base cap 354 attachable to base 130 of wall assembly 102. Stud cap 352 and base cap 354 cooperate to retain any of the moisture transport sheets described above, such as MTS 124, against wall frame 104 and secure moisture wicking sheet 118 under wall frame 104 and in contact with MTS 124.

In one embodiment, stud cap 352 is coupled to ends of vertical studs of wall frame 104 through pre-located slots from to provide a desired spacing between the studs and includes a stud plate 360 attached to a bottom of the vertical studs and a stud flange 362 extending from stud plate 360. In one embodiment, base cap 354 includes a base plate 370 attachable to base 130 and a base flange 372 extending from base plate 370. When assembled, MTS 124 is retained between stud flange 362 and base flange 372, and moisture wicking sheet 118 is placed on seal strip 342 in contact with MTS 124 and extends out from wall frame 104 between stud plate 360 and base plate 370. Thus, moisture wicking sheet 118 communicates with MTS 124 when wall assembly 102 is erected and forms a moisture conduit (a pathway for the flow of moisture to follow) extending from wall frame 104 to a dynamically ventilated trough 380.

Moisture vapor that accumulates within wall assembly 102 will condense on film 200 (FIG. 6) of MTS 124 and bulk moisture that enters wall assembly is captured and directed by one of the moisture wicking layers 202, 204 (FIG. 6). The moisture, whether from vapor or liquid, is transported down MTS 124 toward wicking sheet 118. Wicking sheet 118 directs moisture out of wall assembly 102 into a trough 380 formed by a baseboard plate 382 that is attached to base cap 354.

Trough 380 communicates with a dynamic ventilation system configured to remove moisture that is collected in trough 380. Trough 380 is attached to an interior side of wall assembly 102 in one embodiment. Trough 380 is attached to base 130 inside of wall assembly 102 in one embodiment.

In one embodiment, baseboard plate 382 forms a plenum and includes a fan 386 or an active drying mechanism 386 that is configured to blow air into/across trough 380 and evaporate moisture delivered into trough 380 by wicking sheet 118. Operating fan 386 will generally form a region or zone of lower vapor pressure within trough 380, which will encourage or dynamically drive the flow of moisture away from wall frame 104, down MTS 124, and along wicking sheet 118. Fan 386 is thus configured to dynamically draw moisture out of wall assembly 102 into trough 380 and to actively evaporate the moisture as it is collected in trough 380. It is acceptable to provide baseboard plate 382 with openings that enable air blown by fan 386 to exit the plenum formed by the baseboard plate 382. In one embodiment, active drying mechanism 386 includes a connection between the plenum and a central forced air system, where the central forced air system is configured to force warm, dry air through the trough 380 in winter and cool, dry air through the trough 380 in summer.

In one embodiment, trough 380 includes a heated rod disposed inside baseboard plate 382, where the heated rod (or other source of heat) is employed to drive moisture out of trough 380. Such an arrangement can also serve as a baseboard space heating device.

Seal 116 prevents pressure driven advection of moist air that could possibly be blown back into the space between stud cap 352 and base plate 354 as fan 386 operates. In addition, during humid months seal 116 prevents the diffusion of water vapor from humid exterior regions outside of wall assembly 102 from being drawn into regions of wall assembly 102 that have already been dried by MTS 124 and wicking sheet 118. Seal 116 and seal 342 combine to allow liquid to be drained from a lower portion of wall assembly 102 while sealing interior and exterior cavities of wall assembly 102 (relative to MTS 124) from interior sources of moisture. The interior sources of moisture include the diffusion of moisture caused by humidity gradients or moisture that arises from a pressure differential within wall assembly 102 in which the interior pressure of wall assembly 102 is greater than the exterior pressure. In addition, seal 116 and seal 342 combine to prevent leakage of moisture arising from a negative pressure differential (where the exterior pressure of wall assembly 102 is greater than the interior pressure), which prevents exterior air from infiltrating to the interior.

In one embodiment, fan 386 is an electric fan having a cross-sectional area between about 2-10 square inches and is electrically coupled to a moisture sensor 388 coupled to wicking sheet 118. Moisture sensor 388 includes a pair of spaced apart electrodes that are sensitive to the presence of moisture in the form of sensed capacitance or sensed change in resistance. For example, when wicking sheet 118 is transporting moisture, the moisture will generally increase capacitance across the electrodes. The change in the capacitance across the electrodes of moisture sensor 388 is configured to be sensed by fan 386, resulting for example in activating fan 386 at a predetermined sensed moisture level as recorded by moisture sensor 388. In one embodiment, moisture sensor 388 includes a voltage output that correlates to a level of moisture within wicking sheet 118. Fan 386 is selectively activated when moisture in sheet 118 exceeds the pre-set desired moisture level, thus dynamically drying moisture within trough 382 and sheet 118. When the moisture in sheet 118 drops below the pre-set desired moisture level fan 386 shuts off.

In the embodiment, moisture sensor 388 includes two wires of particular resistivity, and the wicking material forms a capacitor with the wicking material as the dielectric. The dielectric strength (capacitance) increases with moisture content in a direct and measurable way. This capacitance is detected by the electronics and converted into a voltage signal that is used in the embodiment to control the fan as well as provide a visual (e.g., via a light emitting diode) and digital indication (e.g., via a data logger) of the state of moisture of the wicking layer and thus by inference of the wall system.

In one embodiment, the moisture transport spacer (MTS 124 or Dryspacer) is positioned between interior and exterior vapor permeable membranes 142, 190 (FIG. 5). MTS described herein include a barrier to the through-passage of moisture through wall assembly 102, such that the vapor permeable membrane 142 enables water vapor entering wall assembly 102 from the exterior to be dried to the exterior by evaporation, and the vapor permeable membrane 190 enables water vapor entering wall assembly 102 from the interior to be dried to the interior by evaporation.

Figure 17:
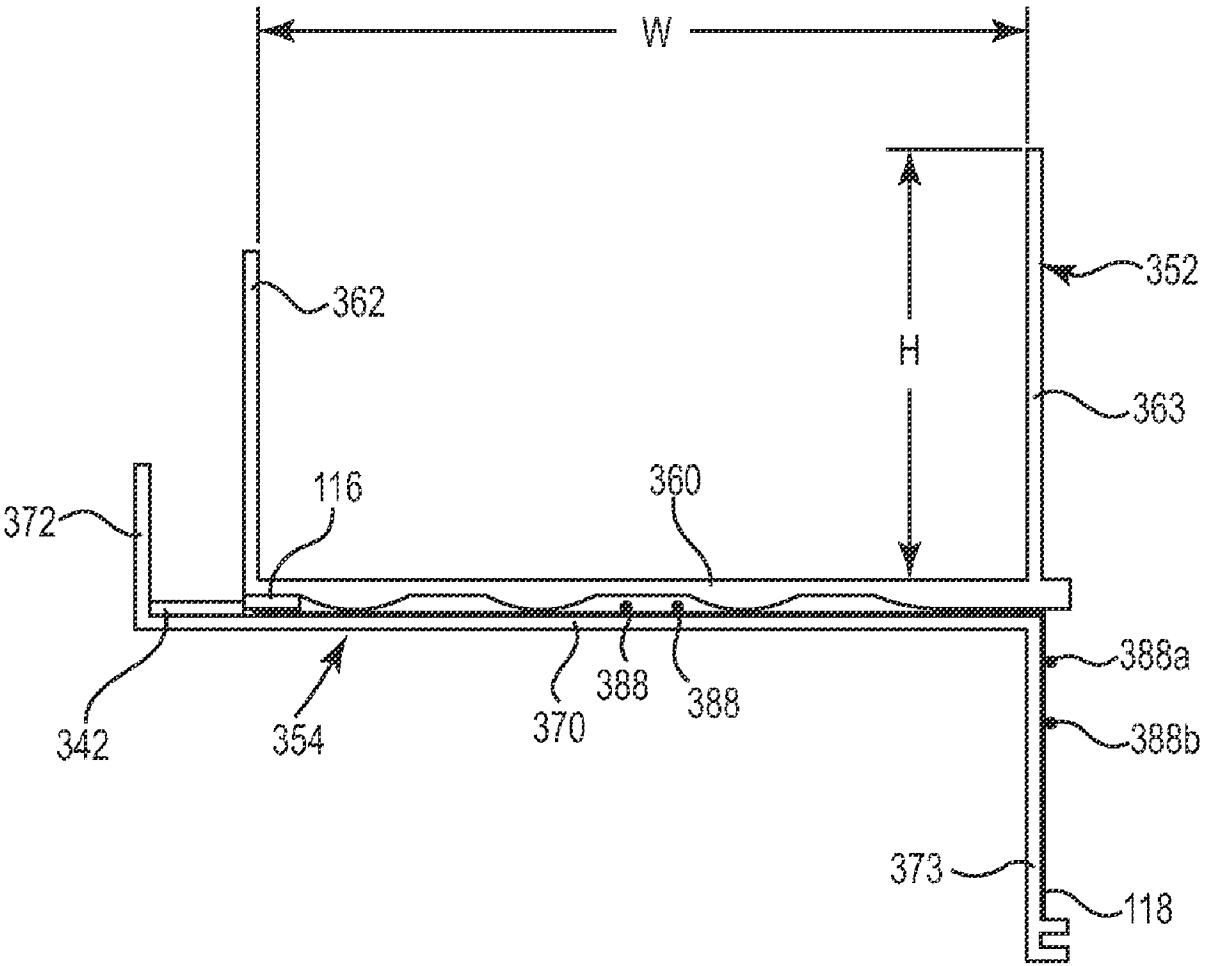
FIG. 17 is a schematic cross-sectional view of a stud cap configured for attachment to wall studs and attachable to a base cap configured for attachment to a base of an exterior wall assembly according to one embodiment.
Figure 18:
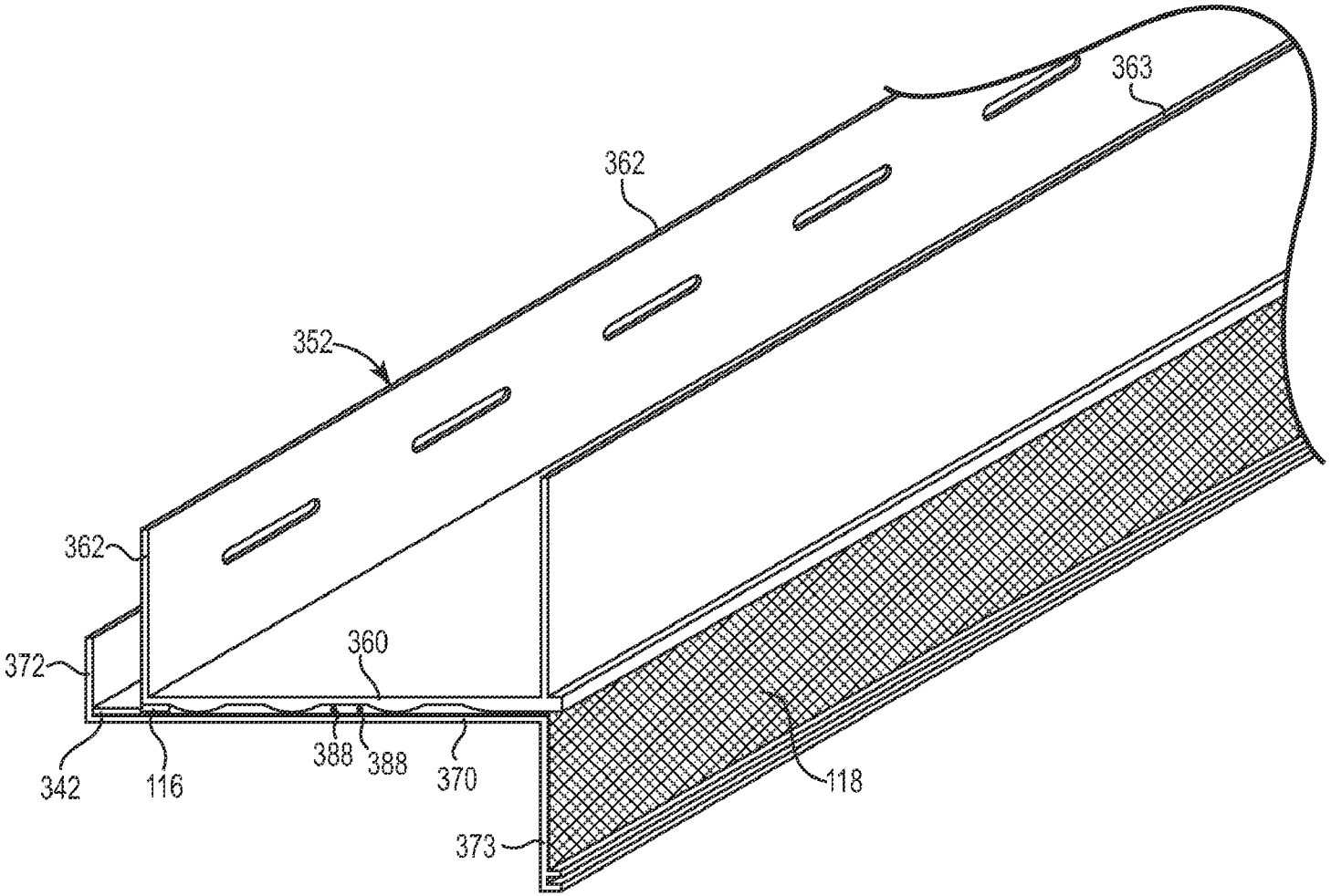
FIG. 18 is a perspective view of the stud cap attached to the base cap as illustrated in FIG. 17 according to one embodiment.

FIG. 17 is a schematic cross-sectional view and FIG. 18 is a perspective view of stud cap 352 operatively oriented relative to base cap 354. In one embodiment, stud cap 352 is generally a U-shaped cap including opposing flanges 362, 363 extending from base plate 360. Wall frame 104 (FIG. 5) includes vertical studs supported by a lateral bottom board, and flanges 362, 363 are configured to engage with the lateral bottom board. For example, in one embodiment the lateral bottom board is provided as a 2×4 stud and stud cap 352 has a width W of about 3.5 inches and a height H of about 2 inches to enable flanges 36, 363 to be secured over the 2×4 bottom board.

Stud cap 352 is configured to carry and distribute the load of wall frame 104, and in one embodiment an exterior surface of base plate 360 is structured to have a load dissipating structure that distributes the weight of wall assembly 102 evenly over base 130 (FIG. 16) and base cap 354.

When stud cap 352 is assembled relative to base cap 354, foam seal 342 is disposed between flanges 362, 372, a portion of wicking sheet 118 is attached to foam seal 342 to communicate with MTS 124 (FIG. 16), and seal 116 is disposed between wicking sheet 118 and the exterior lower surface of stud plate 360 to provide an air-sealed gap between stud cap 352 and base cap 352. Wicking sheet 118 and MTS 124 combine to transport moisture out from between stud cap 352 and base cap 352. In one embodiment, wicking sheet 118 extends over a surface of base plate 370 and an exterior surface of lower flange 373 to ensure that moisture is directed away from the wall frame to which the caps 352, 354 are attached. As illustrated, one embodiment includes multiple moisture sensors 388 attached to and distributed over wicking sheet 118.

Figure 19:
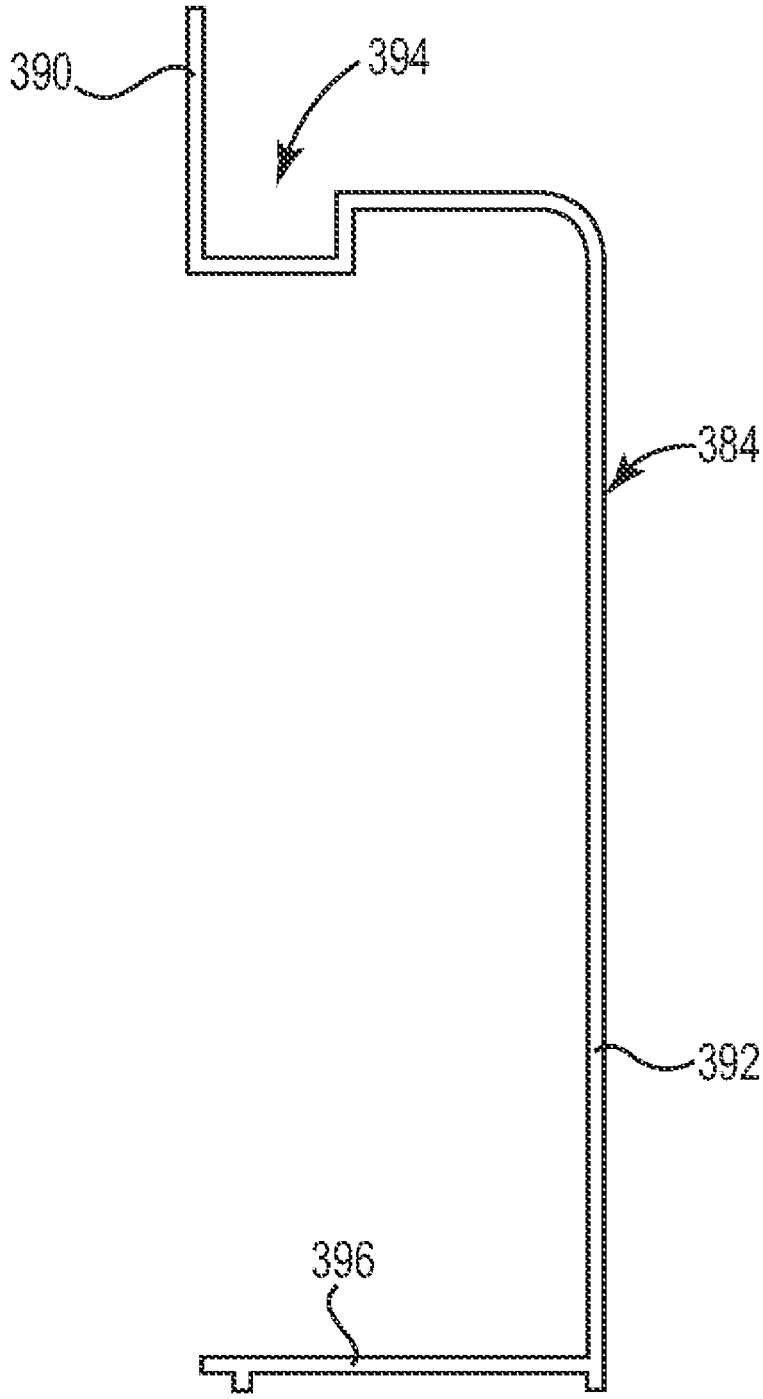
FIG. 19 is a side view of a baseboard housing configured for attachment to the stud cap and the base cap illustrated in FIG. 18 according to one embodiment.

FIG. 19 is a schematic cross-sectional view of baseboard plate 382. In one embodiment, baseboard plate 382 includes a frame plate 390 that combines with a face plate 392 to form a recess 394 that is sized to receive interior wall layer 180 of wall assembly 102 (FIG. 16). A trough flange 396 extends from face plate 392 and is attachable to flange 373 (FIG. 17) of base cap 354 to form trough 380 (FIG. 16).

Frame flange 390 is attachable to wall frame 104 to rigidly secure baseboard plate 382 against stud cap 352 and base cap 354 to form the plenum described in FIG. 16. In one embodiment, fan 386 (FIG. 16) is attached to an interior side of baseboard plate 382 and is electrically coupled to moisture sensors 388. In one embodiment, baseboard plate 382 defines a height of about 4.5 inches and a width of about 1.5 inches. Other sizes and shapes for housing 384 are also acceptable.

Figure 20:
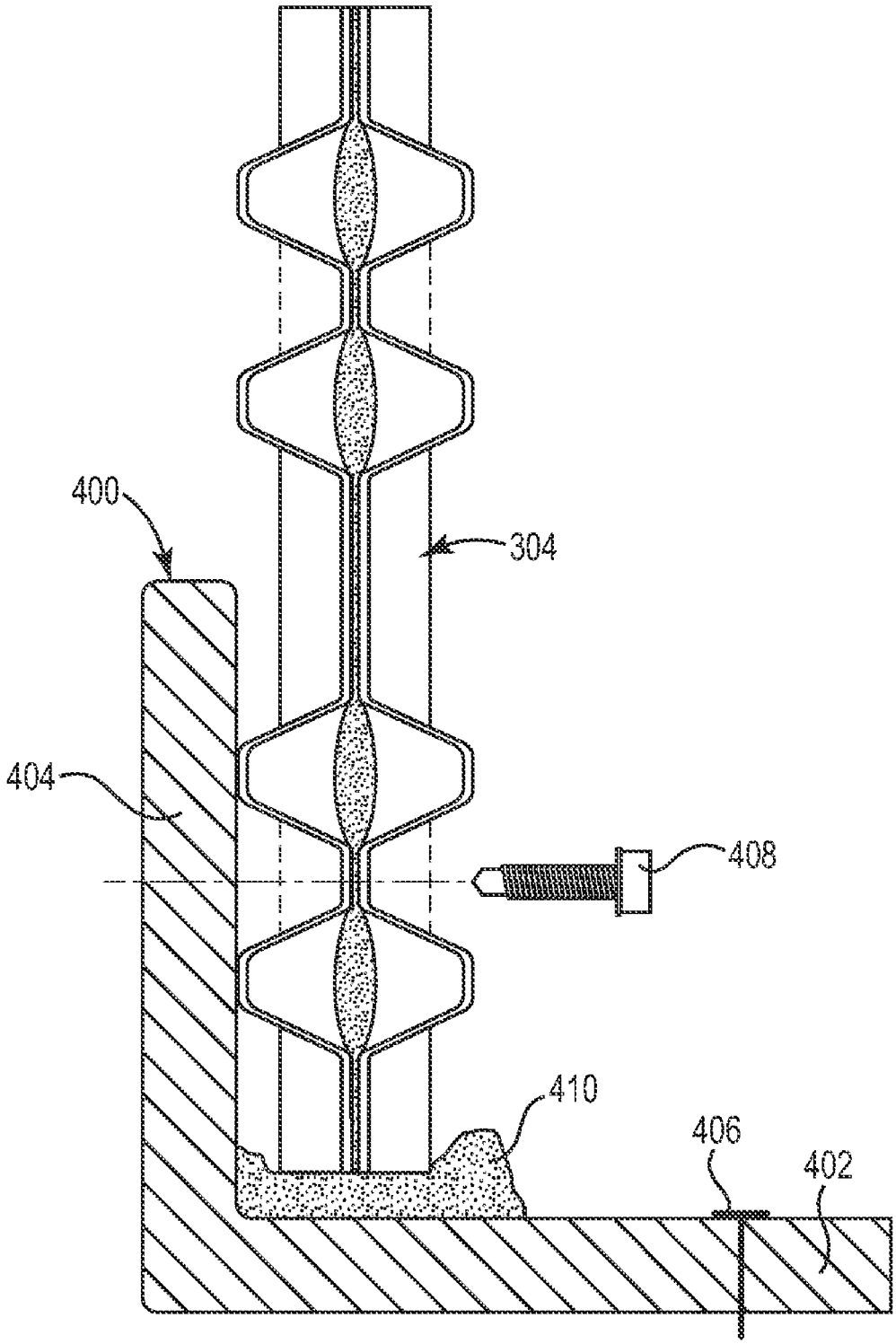
FIG. 20 is a schematic cross-sectional view of the moisture transport spacer illustrated in FIG. 12B retained in another rough opening edge seal according to one embodiment.

FIG. 20 is a schematic cross-sectional view of moisture transport spacer 304 (MTS 304) retained in another embodiment of a rough opening edge seal 400. Rough opening edge seal 400 is configured to retain any of the moisture transport sheets described above. In one embodiment, edge seal 400 is configured to simplify the installation of MTS 304 and includes a base flange 402 coupled to a vertical flange 404. Base flange 402 is configured to be placed on a horizontal support within the wall assembly, for example base 130 (FIG. 16), and is held in place by a suitable attachment device such as a nail 406. Vertical flange 404 is configured to mate against a vertical stud or other support within the wall and is held in place by a suitable attachment device, such as a self-drilling screw 408.

In one embodiment, MTS 304 is coupled to edge seal 400 by a sealant 410 that seals an end of MTS 304 to one or both of base flange 402 and vertical flange 404. In one embodiment, sealant 410 is a moisture-curing sealant foam, although other forms of sealant are also acceptable. In one embodiment, sealant 410 is a foam adhesive delivered from a pressurized spray canister. Edge seal 400 is compatible with accepted practices for wall construction and is configured to enable a contractor to conveniently install MTS 304 along any rough opening within a wall assembly by simply securing edge seal 400 and bonding MTS 304 in place against edge seal 400.

Figure 21:
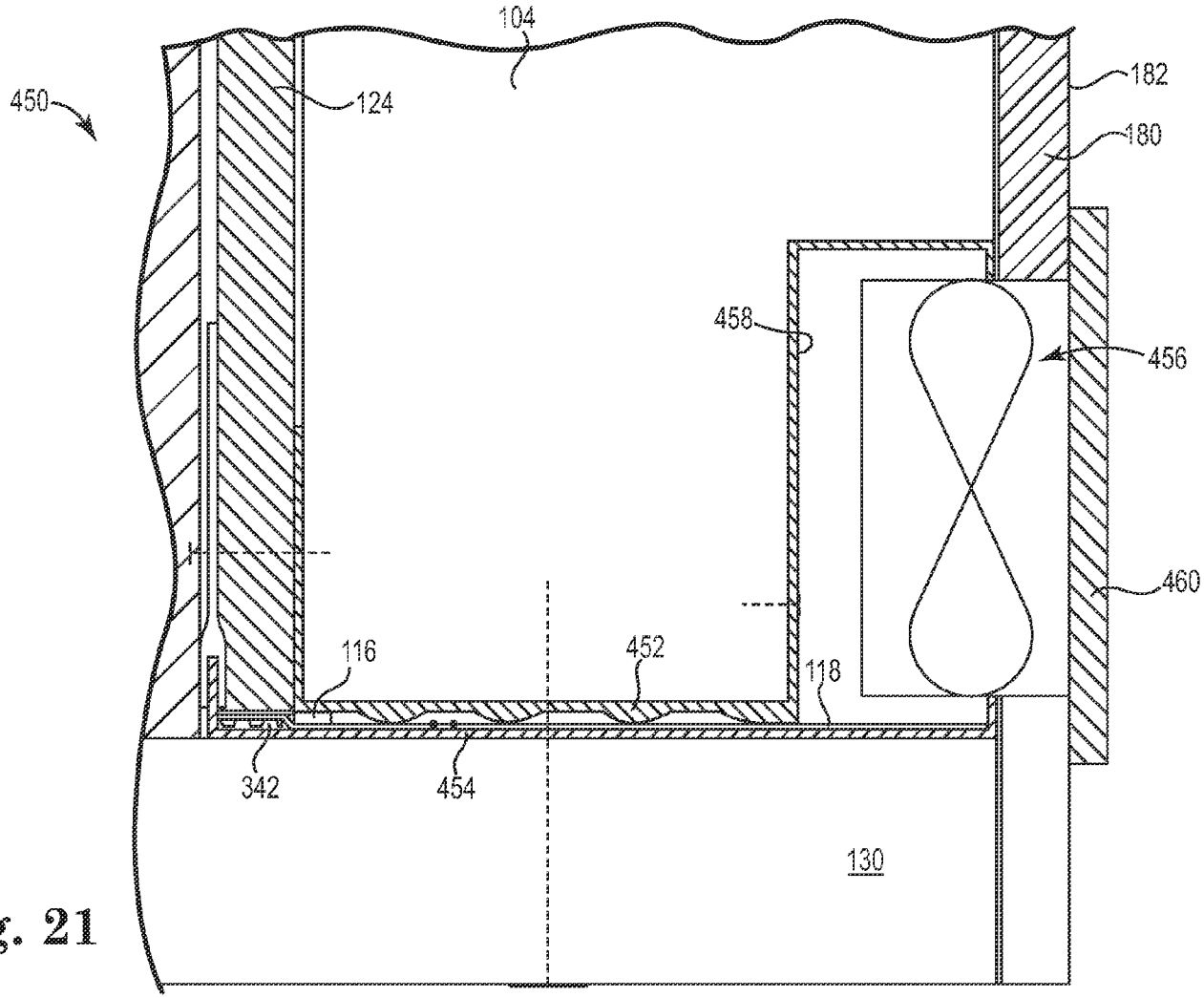
FIG. 21 is a schematic cross-sectional view of an exterior wall assembly according to one embodiment.

FIG. 21 is a schematic cross-sectional view of an exterior wall assembly 450 according to one embodiment. Exterior wall assembly 450 includes a stud cap 452 attachable to wall frame 104, a base cap 454 attachable to base 130 of wall assembly 102, MTS 124 disposed alongside wall frame 104, and an active drying mechanism 456 disposed within a trough 458 that is integrated into interior wall 180, where trough 458 is covered with a vent 460.

Stud cap 452 and base cap 454 cooperate to retain any of the moisture transport sheets described above, such as MTS 124, against wall frame 104 and secure moisture wicking sheet 118 under wall frame 104 and in contact with MTS 124.

Trough 458 collects bulk moisture extracted from wall assembly 102 by MTS 124, and active drying mechanism 456 evaporates the moisture from trough 458. In one embodiment, active drying mechanism 456 is a fan that evaporates the moisture from trough 458 by forcing air along trough and out of vent 460. In one embodiment, active drying mechanism 456 is a heat source that evaporates the moisture from trough 458 into an interior room through vent 460.

In one embodiment, vent 460 and trough 458 are integrated into wall assembly so that vent 460 has the appearance of a baseboard.

Figure 22:
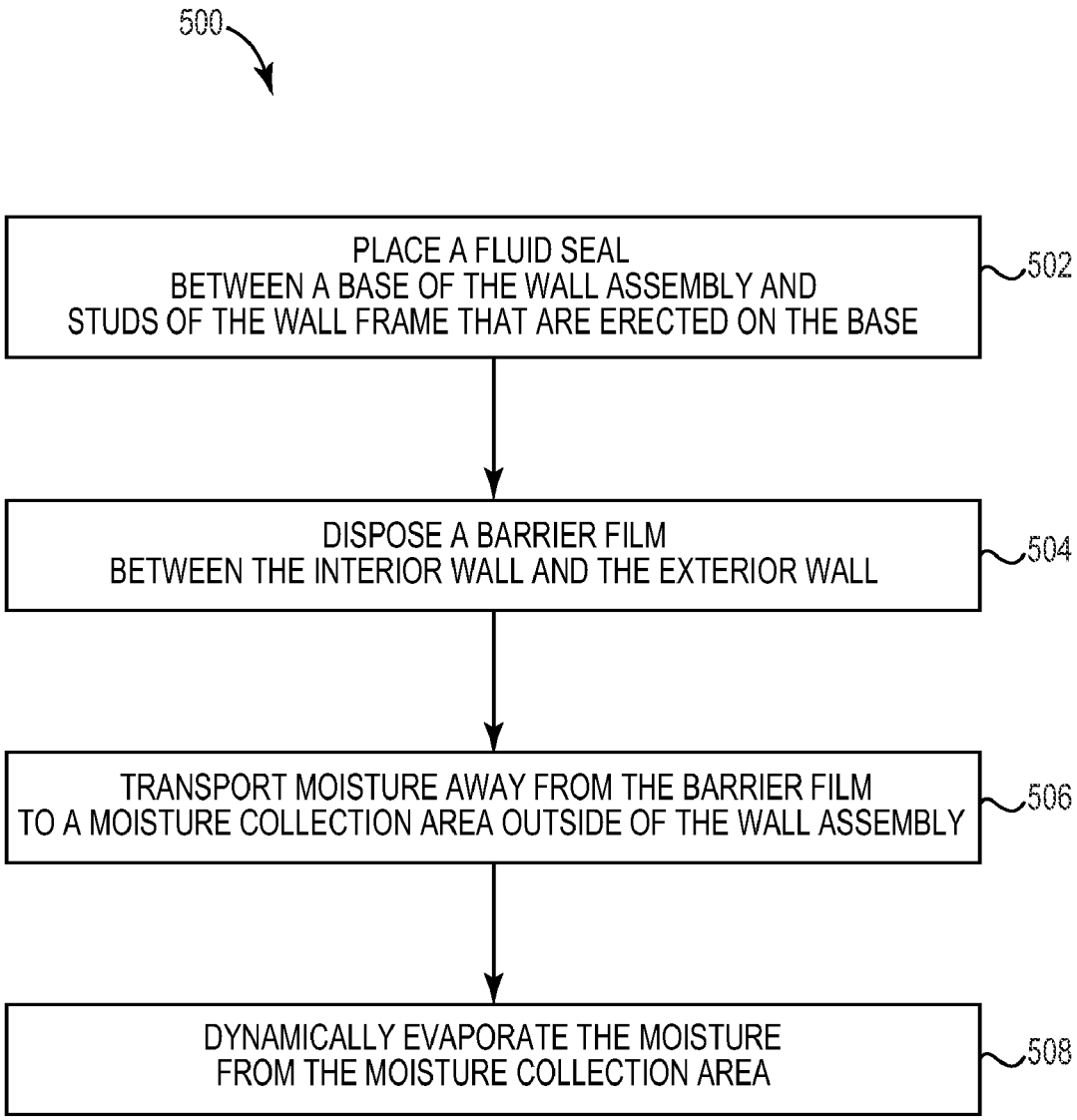
FIG. 22 is a flow diagram of a method of removing moisture from a wall assembly according to one embodiment.

FIG. 22 is a flow diagram of a process 500 of removing moisture from a wall assembly according to one embodiment. Process 500 includes placing a fluid seal between a base of a wall assembly and studs of a wall frame at 502. At 504, process 500 includes disposing a barrier film between the interior wall and the exterior wall of the wall assembly. At 506, moisture is transported away from the barrier film to a moisture collection area outside the wall assembly. At 508, the moisture within the moisture collection area is dynamically evaporated to dry out the moisture collection area and to dry a space between the interior wall and the exterior wall. In one embodiment, process 500 dries interior surfaces of a sealed wall assembly to a moisture content of less than approximately 6%, for example to a moisture content of approximately 2%, which is a level that resists the growth of mold and/or bacteria.

Comparative Example

Features of embodiments of exterior wall assemblies as illustrated in FIG. 16, for example, were compared to a Reference Standard Test Panel.

The Reference Standard Test Panel and a Comparative MTS Test Panel similar to the structure illustrated in FIG. 16 were evaluated in a conditioned environment having a relative humidity of about 50 percent. The moisture content inside of the wall assembly was recorded over the course of about 100 days for both the Reference Standard Test Panel and the Comparative MTS Test Panel.

The components of each of each of the test panels are listed in Table 1 below. The Reference Standard Test Panel includes components that are typically used in the construction industry to form a sealed wall assembly and include a breathable water resistive layer attached to a sheathing of oriented-strand board (OSB) which is covered by exterior cladding, insulation, and a warm-side vapor retarder (e.g., a 2 mil polyamide-6 membrane) placed inside an interior finish layer. The insulation is provided by an unfaced fiberglass batt (R-19 insulation value) placed between the wall studs.

The Comparative MTS Test Panel is constructed in a manner similar to the Reference Standard Test Panel but includes an MTS layer as described herein deposited between the sheathing and the warm-side vapor retarder. For example, the insulation is provided by an extruded polystyrene insulation, and unfaced fiberglass batt (R-13 insulation value) placed between the wall studs with the MTS layer placed between the studs and the extruded polystyrene insulation. Consequently, the comparative results between the two test panels represent the performance advantage provided by the MTS (or Dryspacer layer).

TABLE 1

| Wall Assembly Component | Reference Standard Test Panel | Comparative MTS Test Panel |
|---|---|---|
| Cladding | Fiber cement board | Fiber cement board |
| Breathable Water resistive layer | Spun bonded polyolefin | Spun bonded polyolefin |
| Sheathing | ½" OSB | ½" OSB |
| Insulation system | R-19 unfaced fiberglass batt | 1.5" extruded polystyrene, MTS, R-13 unfaced fiberglass batt |
| Warm-side vapor retarder | 2-mil. PA-6 | 2-mil. PA-6 |
| Interior finish layer | ½" gypsum with 3-coats of latex paint | ½" gypsum (unpainted) |

Each of the test panels were evaluated in a conditioned environment.

Figure 23A:
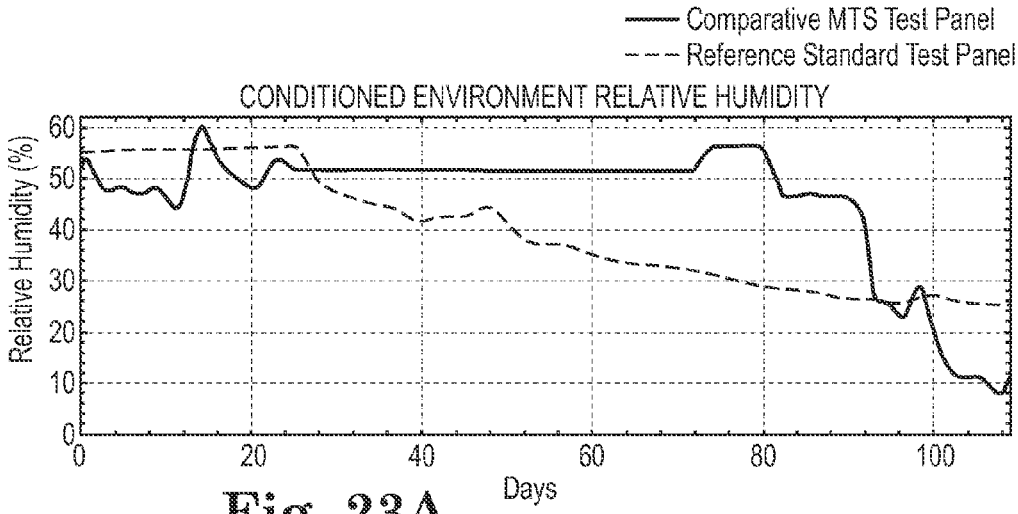
FIG. 23A is a graph of relative humidity inside a conditioned environment to which a standard wall and a comparative wall were challenged with high relative humidity and FIG. 23B is a graph of relative humidity inside each of the standard wall and the comparative wall during the high-humidity challenge.

FIG. 23A is a graph of the relative humidity in the conditioned environment. The interior side of each test panel was exposed to the conditioned environment. Note that the relative humidity in the conditioned environment was generally above 30%, and that the conditioned environment to which the Comparative MTS Test Panel was exposed was maintained at a nearly constant 50% relative humidity between approximately days 25-75. Thus, as illustrated in FIG. 23A, the Comparative MTS Test Panel was challenged with a generally higher relative humidity as compared to the Reference Standard Test Panel.

Figure 23B:
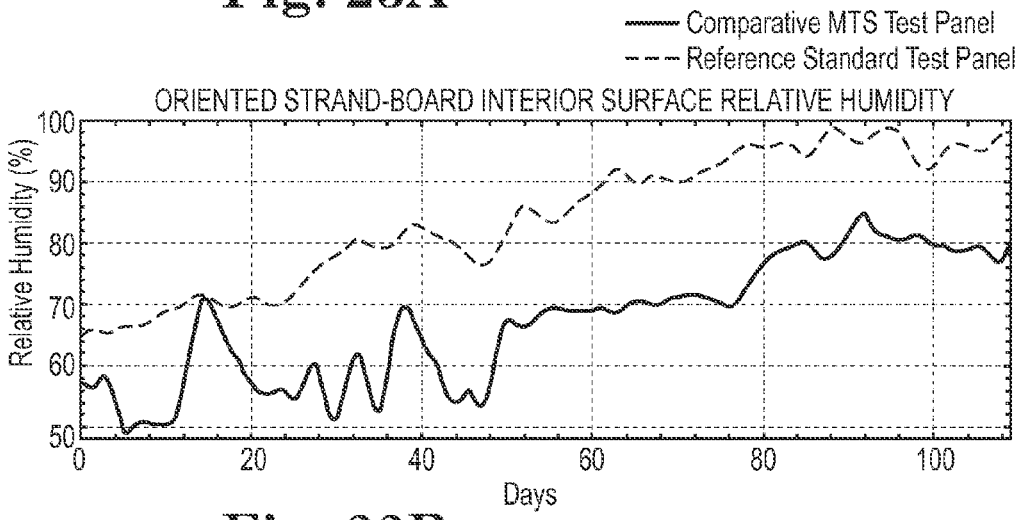

FIG. 23B is a graph of relative humidity measured along an inside surface of oriented-strand board for both the Comparative MTS Test Panel and the Reference Standard Test Panel. With additional reference to FIG. 16, the data for FIG. 23B were measured along an inside surface of OSB 194.

Figure 23C:
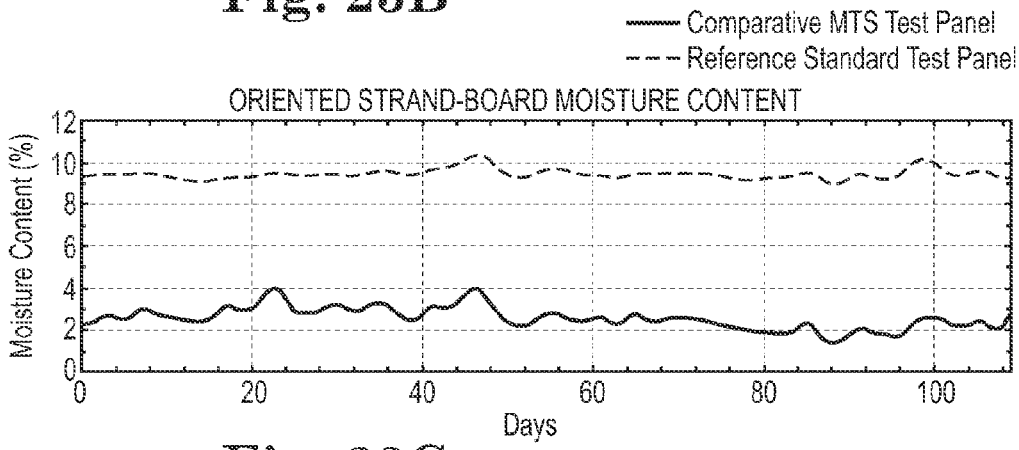
FIG. 23C is a graph of moisture content for a layer of oriented-strand board moisture for each of the standard wall and the comparative wall as recorded over a hundred day period.

FIG. 23C is a graph of moisture content in the oriented-strand board layer over a 100 day period for both the Comparative MTS Test Panel and the Reference Standard Test Panel. The Reference Standard Test Panel has a moisture content of approximately 10% measured on the inside surface of the OSB in the sealed wall assembly. In contrast, the moisture transport sheet 124 and the moisture wicking sheeting 118 (FIG. 16) as described above combine to transport moisture out of the sealed wall assembly such that the Comparative MTS Test Panel has a moisture content of approximately 2% measured on the inside surface of the OSB in the sealed wall assembly.

In one embodiment, the Comparative MTS Test Panel has a moisture content that is approximately a factor of 2.5 less than a moisture content of the Reference Standard Test Panel. The Comparative MTS Test Panel is drier than the conventional wall structure and can be dried to a level that precludes the growth of bacteria, mold, or the formation of rot.

It is noted that the Comparative MTS Test Panel was assembled in the configuration illustrated in FIG. 16 and included fan 386. Over the course of the evaluation, fan 386 would occasionally be activated to evaporate moisture drawn out of the wall assembly. Fan 386 did not run continuously.

Mechanisms are provided that are configured to remove moisture from interior surfaces of a sealed wall assembly. It has been surprisingly discovered that providing a moisture barrier (in the form of a moisture transport spacer) that communicates with a moisture wicking sheet will remove high levels of moisture from the wall assembly, thus drying out the wall assembly.

The sealed wall assembly described above includes one or more moisture transporting sheets that are sealed within the wall assembly and provide a moisture wicking pathway for water to be directed out of the wall assembly. The wall assemblies described above comply with local and state building codes and are configured to be easily assembled without additional tools or approaches that would be new to the skilled contractor.

The sealed wall assemblies described above are believed to offer improved severe weather performance, for example in acting to stop of slow down flying debris; offer increased R-value insulation performance; and offer improved structural acoustics.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of removing moisture from a wall assembly comprising an interior wall and an exterior wall disposed opposite the interior wall, the method comprising:

sealing, with a moisture seal, between a base of the wall assembly and supporting structure of the wall assembly erected on the base;

providing a water separation plane, between the interior wall and the exterior wall, the water separation plane providing a substantial barrier to moisture vapor and bulk water;

transporting moisture along an interior side and an opposing exterior side of the water separation plane to a moisture collection area outside of the wall assembly, wherein transporting moisture comprises directing the moisture transported along the interior side and the exterior side of the water separation plane through a fibrous structure disposed under the moisture seal and under the supporting structure of the wall assembly to the moisture collection area outside of the wall assembly; and removing the moisture from the moisture collection area.

2. The method of claim 1, wherein transporting moisture comprises directing, with a wicking sheet, the moisture transported along the interior side and the exterior side of the water separation plane, the directing including wicking the moisture with capillary action under the supporting wall to the moisture collection area outside of the wall assembly.

3. The method of claim 1, wherein removing comprises intermittently or continuously directing air flow across the moisture collection area.

4. The method of claim 1, wherein excess moisture transported along the interior side of the water separation plane is removed from a portion of the moisture collection area positioned adjacent to the interior wall.

5. The method of claim 1, wherein excess moisture transported along the exterior side of the water separation plane is removed from a portion of the moisture collection area positioned adjacent to the exterior wall.

6. The method of claim 1, wherein removing comprises dynamically evaporating the moisture.

7. The method of claim 1, wherein removing comprises employing a central forced air system.

8. The method of claim 1, wherein removing comprises heating the moisture in the moisture collection area.

9. The method of claim 1, wherein removing comprises passively removing the moisture.

10. The method of claim 1, wherein the exterior wall comprises a structural wall and the interior wall comprises a structural wall.

11. The method of claim 1, wherein one of the exterior wall and the interior wall comprises a structural wall and the other of the exterior wall and the interior wall is a non-structural wall.

12. The method of claim 11, wherein the non-structural wall is one of a finishing layer and a wall assembly.

13. A method of removing moisture from a wall assembly comprising an interior wall and an exterior wall disposed opposite the interior wall, the method comprising:

sealing, with a moisture seal, between a base of the wall assembly and supporting structure of the wall assembly erected on the base;

providing a water separation plane, between the interior wall and the exterior wall, the water separation plane providing a substantial barrier to moisture vapor and bulk water;

transporting moisture along an interior side and an opposing exterior side of the water separation plane to a moisture collection area outside of the wall assembly; and removing the moisture from the moisture collection area, wherein the water separation plane comprises:

disposing a first section of moisture vapor barrier film between the interior wall and the exterior wall;

separating a first layer of the first section of moisture vapor barrier film from a second layer of the first section of moisture vapor barrier film;

engaging a second section of moisture vapor barrier film between the first and second separated layers of the first section of moisture vapor barrier film; and sealing the first section of moisture vapor barrier film to the second section of moisture vapor barrier film.

14. The method of claim 13, wherein transporting moisture comprises directing, with a draining sheet, the moisture transported along the interior side and the exterior side of the water separation plane away from the water separation plane to the moisture collection area.

15. The method of claim 13, wherein transporting moisture comprises directing, with a fibrous structure, the moisture transported along the interior side and the exterior side of the water separation plane away from the water separation plane to the moisture collection area.

16. The method of claim 13, wherein the exterior wall comprises a structural wall and the interior wall comprises a structural wall.

17. The method of claim 13, wherein one of the exterior wall and the interior wall comprises a structural wall and the other of the exterior wall and the interior wall is a non-structural wall.

18. The method of claim 17, wherein the non-structural wall is one of a finishing layer and a wall assembly.

* * * * *